US007097559B2

(12) United States Patent
Okita et al.

(10) Patent No.: US 7,097,559 B2
(45) Date of Patent: Aug. 29, 2006

(54) GAME SYSTEM AND METHOD FOR ASSIGNING TITLES TO PLAYERS BASED ON HISTORY OF PLAYING CHARACTERISTICS

(75) Inventors: Katsunori Okita, Kobe (JP); Kazutaka Kubota, Akashi (JP); Yuuki Harano, Kobe (JP); Hiroyuki Wada, Kobe (JP); Masakazu Shibamiya, Kobe (JP); Takashi Makiishi, Kobe (JP)

(73) Assignee: Konami Corporation, Tokyo (JP)

( * ) Notice: Subject to any disclaimer, the term of this patent is extended or adjusted under 35 U.S.C. 154(b) by 162 days.

(21) Appl. No.: 10/266,024

(22) Filed: Oct. 7, 2002

(65) Prior Publication Data

US 2003/0073488 A1 Apr. 17, 2003

(30) Foreign Application Priority Data

Oct. 17, 2001 (JP) ..... 2001-319866

(51) Int. Cl.
*A63F 9/24* (2006.01)

(52) U.S. Cl. ..... 463/11; 463/16

(58) Field of Classification Search ..... 463/1, 463/11–42; 700/91; 273/121 B
See application file for complete search history.

(56) References Cited

U.S. PATENT DOCUMENTS 4,710,873 A * 12/1987 Breslow et al. ..... 463/31
5,711,715 A 1/1998 Ringo et al.
5,779,549 A 7/1998 Walker et al.
5,809,482 A 9/1998 Strisower
6,012,981 A * 1/2000 Fujioka et al. ..... 463/11
6,082,887 A * 7/2000 Feuer et al. ..... 700/91
6,224,486 B1 * 5/2001 Walker et al. ..... 463/42
6,336,858 B1 * 1/2002 Yoseloff ..... 463/13
6,354,939 B1 * 3/2002 Morita et al. ..... 463/1
6,354,943 B1 * 3/2002 Miura ..... 463/29
6,371,854 B1 * 4/2002 Ikeda et al. ..... 463/42
6,398,642 B1 * 6/2002 Kim ..... 463/11
6,406,371 B1 * 6/2002 Baba et al. ..... 463/42
6,416,053 B1 * 7/2002 Kamimura ..... 273/121 B
6,425,828 B1 * 7/2002 Walker et al. ..... 463/42
6,454,648 B1 * 9/2002 Kelly et al. ..... 463/16
6,605,003 B1 * 8/2003 Suchocki et al. ..... 463/29

FOREIGN PATENT DOCUMENTS

EP 1147793 A2 * 10/2001

(Continued)

OTHER PUBLICATIONS

Frase, Tuesday et al. "The Official Guide to Ultima Online". Origin Systems, Inc. Austin, TX, 1997, pp. 1, 2, 22-23, 28-30, 34-36, 103, 104.*

(Continued)

*Primary Examiner*—Julie Brocketti
(74) *Attorney, Agent, or Firm*—Jordan and Hamburg LLP

(57) ABSTRACT

The CPU 161 of the video game apparatus comprises a performance determination unit 161*b* that determines the order of finish of the players each time a game is completed, a parameter calculation unit 161*g* that calculates parameters indicating the characteristics of each player in playing games based on the game history data stored in a history storage unit 162*b* described below and a title assigning unit 161*h* that assigns a title applicable during games to each player based on the calculated parameters, and the RAM 162 comprises a history storage unit 162*b* that stores past player game history data for each player, and a title storage unit 162*c* that associates the titles assigned by the title assigning unit 161*h* with the players and stores them.

20 Claims, 20 Drawing Sheets

FOREIGN PATENT DOCUMENTS

| | | |
|---|---|---|
| JP | 11-253657 | 9/1999 |
| JP | 2000-140413 | 5/2000 |
| JP | 2000-262742 | 9/2000 |
| JP | 2001-187273 | 7/2001 |
| JP | 2001-212365 | 8/2001 |
| JP | 2001-243153 | 9/2001 |
| JP | 2001-321570 | 11/2001 |
| WO | WO 98/40135 | 9/1998 |

OTHER PUBLICATIONS

"Ultima Online Renaissance Playguide". Electronic Arts. 2000, pp. 60, 61, 64, 65, 76-81.*

"Special Version of a method to surely win against Play Station, New SD Sengoku-den, a great war of riot warriors", Kabushiki Kaisha Keibun-sha, firstly published on Jan. 5, 1997, pp. 10 to 11, 44, 54, 74, and 104.

* cited by examiner

FIG.4

| RANK | POINTS |
|---|---|
| GRADE 10 | 0～99 |
| GRADE 9 | 100～199 |
| GRADE 8 | 200～299 |
| GRADE 7 | 300～399 |
| GRADE 6 | 400～499 |
| GRADE 5 | 500～599 |
| GRADE 4 | 600～699 |
| GRADE 3 | 700～799 |
| GRADE 2 | 800～899 |
| GRADE 1 | 900～999 |

FIG.5

| RANK | NUMBER OF CHIPS POSSESSED (TC) |
|---|---|
| 1ST DEGREE MASTER | $1 \leqq TC < 5$ |
| 2ND DEGREE MASTER | $5 \leqq TC < 10$ |
| 3RD DEGREE MASTER | $10 \leqq TC < 16$ |
| 4TH DEGREE MASTER | $16 \leqq TC < 22$ |
| 5TH DEGREE MASTER | $22 \leqq TC < 29$ |
| 6TH DEGREE MASTER | $29 \leqq TC < 37$ |
| 7TH DEGREE MASTER | $37 \leqq TC < 46$ |
| 8TH DEGREE MASTER | $46 \leqq TC < 56$ |

FIG.6

| Level | Quick-win (phoenix) | Defense-first (turtle) | Luck-dependent (dragon) | Attack-minded (tiger) |
|---|---|---|---|---|
| | Win ratio | 'Furikomi' ratio | Average number of 'dora' tiles | Average number of exponentials |
| 10 | 0.40 or higher | 0.10 or lower | 2.0 or higher | 4.5 or higher |
| 9 | ~0.38 | ~0.11 | ~1.9 | ~4.4 |
| 8 | ~0.36 | ~0.12 | ~1.8 | ~4.3 |
| 7 | ~0.34 | ~0.13 | ~1.7 | ~4.2 |
| 6 | ~0.32 | ~0.14 | ~1.6 | ~4.1 |
| 5 | ~0.30 | ~0.15 | ~1.5 | ~4.0 |
| 4 | ~0.28 | ~0.16 | ~1.4 | ~3.9 |
| 3 | ~0.26 | ~0.17 | ~1.3 | ~3.8 |
| 2 | ~0.24 | ~0.18 | ~1.2 | ~3.7 |
| 1 | ~0.22 | ~0.19 | ~1.1 | ~3.6 |
| 0 | 0.20 or lower | 0.20 or higher | 1.0 or lower | 3.5 or lower |

FIG.14

DISTRIBUTION OF WINNING HANDS

NUMBER OF WINNING HANDS: 4

| HAND | NUMBER | PROBABILITY | HAND | NUMBER | PROBABILITY |
|---|---|---|---|---|---|
| REACH | 0 | 0.00% | DOUBLE REACH | 0 | 0.00% |
| STRONGLY CLOSED | 0 | 0.00% | ONE-OUT | 0 | 0.00% |
| VALUELESS HAND | 0 | 0.00% | NO TERMINALS | 0 | 0.00% |
| SPECIAL CHAR | 0 | 0.00% | NINE-TILE STRAIGHT | 0 | 0.00% |
| BLOSSOM ON THE HILL | 0 | 0.00% | ROBBING A KONG | 0 | 0.00% |
| CATCHING THE MOON FROM THE BOTTOM OF THE SEA | 0 | 0.00% | CATCHING THE FISH FROM THE BOTTOM OF THE RIVER | 0 | 0.00% |
| TWO IDENTICAL SEQUENCES | 0 | 0.00% | DOUBLE OF TWO IDENTICAL SEQUENCES | 0 | 0.00% |
| EVERY SET INCLUDING MIXED TERMINALS | 0 | 0.00% | EVERY SET INCLUDING TERMINALS | 0 | 0.00% |
| THREE SIMILAR SEQUENCES | 0 | 0.00% | THREE SIMILAR TRIPLETS | 0 | 0.00% |
| SEVEN PAIRS | 0 | 0.00% | ALL TRIPLETS | 0 | 0.00% |
| THREE CONCEALED TRIPLETS | 0 | 0.00% | THREE QUARTETS | 0 | 0.00% |
| MIXED ONE-SUIT | 0 | 0.00% | PURE ONE-SUIT | 0 | 0.00% |
| MIXED TERMINALS | 1 | 25.00% | SMALL THREE DRAGONS | 0 | 0.00% |
| DORA | 8 | 200.00% | END DISCARDS | 0 | 0.00% |
| PURE TERMINALS | 0 | 0.00% | BIG THREE DRAGONS | 0 | 0.00% |
| SMALL FOUR WINDS | 0 | 0.00% | BIG FOUR WINDS | 0 | 0.00% |
| FOUR CONCEALED TRIPLETS | 0 | 0.00% | FOUR QUARTETS | 0 | 0.00% |
| ALL GREEN | 0 | 0.00% | ALL HONORS | 0 | 0.00% |
| THIRTEEN ORPHANS | 0 | 0.00% | NINE LANTERNS | 0 | 0.00% |
| BLESSING OF HEAVEN | 1 | 25.00% | BLESSING OF EARTH | 0 | 0.00% |
| BLESSING OF MAN | 0 | 0.00% | THE CHARIOT | 0 | 0.00% |
| DEALER EIGHT TIMES | 0 | 0.00% | YAKUMAN | 0 | 0.00% |

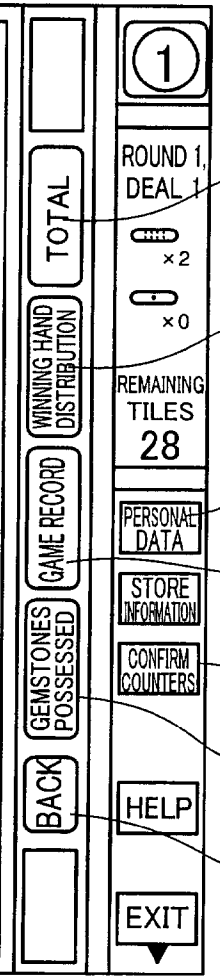

TIB
RDB
PDB
FRB
BNB
HDB
BB 541 542 543 540

GAME SYSTEM AND METHOD FOR ASSIGNING TITLES TO PLAYERS BASED ON HISTORY OF PLAYING CHARACTERISTICS

BACKGROUND OF THE INVENTION

1. Field of the Invention

The present invention pertains to a recording medium which stores a game progress control program, a game progress control program, game progress control method and video game apparatus that control the progress of a game played by a plurality of players while reflecting the game progress on game screens.

2. Description of the Related Art

Various types of multi-player video game apparatuses have been proposed or are currently in use in the conventional art. For example, in the case of a mah-jongg game, a plurality of parameters for each player are changed based on competitive performance, and ranks or the like that indicate the level of each player's skill at mah-jongg are determined based on these parameters. Each player competes seriously in the game in order to increase their own rank.

However, because the relationship between the parameters and the ranks is extremely complex in this conventional mah-jongg video game apparatus, players tend to lack a clear understanding of exactly how to raise their rank. As a result, the motivation to play the game is lost when a two-round game or the like is played, and the game becomes less interesting.

Furthermore, in the case of a mah-jongg game, players must take into account the characteristics of their opponents for deciding their playing style. For example, where an opponent has a 'quick win' game style, the player should try to win quickly as well. However, because it is impossible (or at least difficult) to learn the characteristics of the player's opponents when using a conventional mah-jongg video game apparatus, it is difficult to enjoy the sophistication of mah-jongg, in which the player's own approach changes where necessary in response to the actions of his/her opponents, and this shortcoming has proven to be an obstacle to increasing popular enjoyment of the game.

SUMMARY OF THE INVENTION

The present invention was made in view of the disadvantage described above, and an object thereof is to provide a recording medium which stores a game progress control program, a game progress control program, game progress control method and video game apparatus, which can offer highly enjoyable mah-jongg games.

One form of the present invention relates to a recording medium which stores a game progress control program that controls the progress of a game played by a plurality of players while reflecting the game progress on game screens, wherein said program causes a video game apparatus to function as history storage means that stores past game history data for each player, parameter calculation means that calculates parameters that indicate the characteristics of each player's games based on the game history data, title assigning means that assigns titles applicable during games to the players based on the calculated parameters, and title storage means that associates these titles with the respective players and stores them in memory.

According to the above invention, past game history data is stored for each player in history storage means and parameters indicating the game characteristics of each player are calculated by parameter calculation means. Furthermore, titles applicable during games are assigned to the players based on the calculated parameters, and these titles are associated with the players and stored in title storage means.

Therefore, because a title indicating the characteristics of each player's games is assigned, the player can determine the characteristics of his own games from his own title, and can determine the characteristics of the games of his opponents from their titles. Accordingly, each player can enjoy changing his game approach based on the titles of his opponents, which increases the enjoyment of the game.

These and other objects, features, and advantages of the present invention will become more apparent upon reading the following detailed description along with the accompanying drawings.

BRIEF DESCRIPTION OF THE DRAWINGS

FIG. 4 is a table showing the conditions for the assignment of a rank (Grade 1 through Grade 10) indicating the level of the player's skill at mah-jongg;

FIG. 5 is a table showing the conditions for the assignment of a rank (1st degree master through 8th degree master) indicating the level of the player's skill at mah-jongg;

FIG. 6 is a is a table that describes the conditions for title assignment;

FIG. 14 is a screen drawing of a winning hand distribution screen;

DESCRIPTION OF THE PREFERRED EMBODIMENTS

Figure 1:
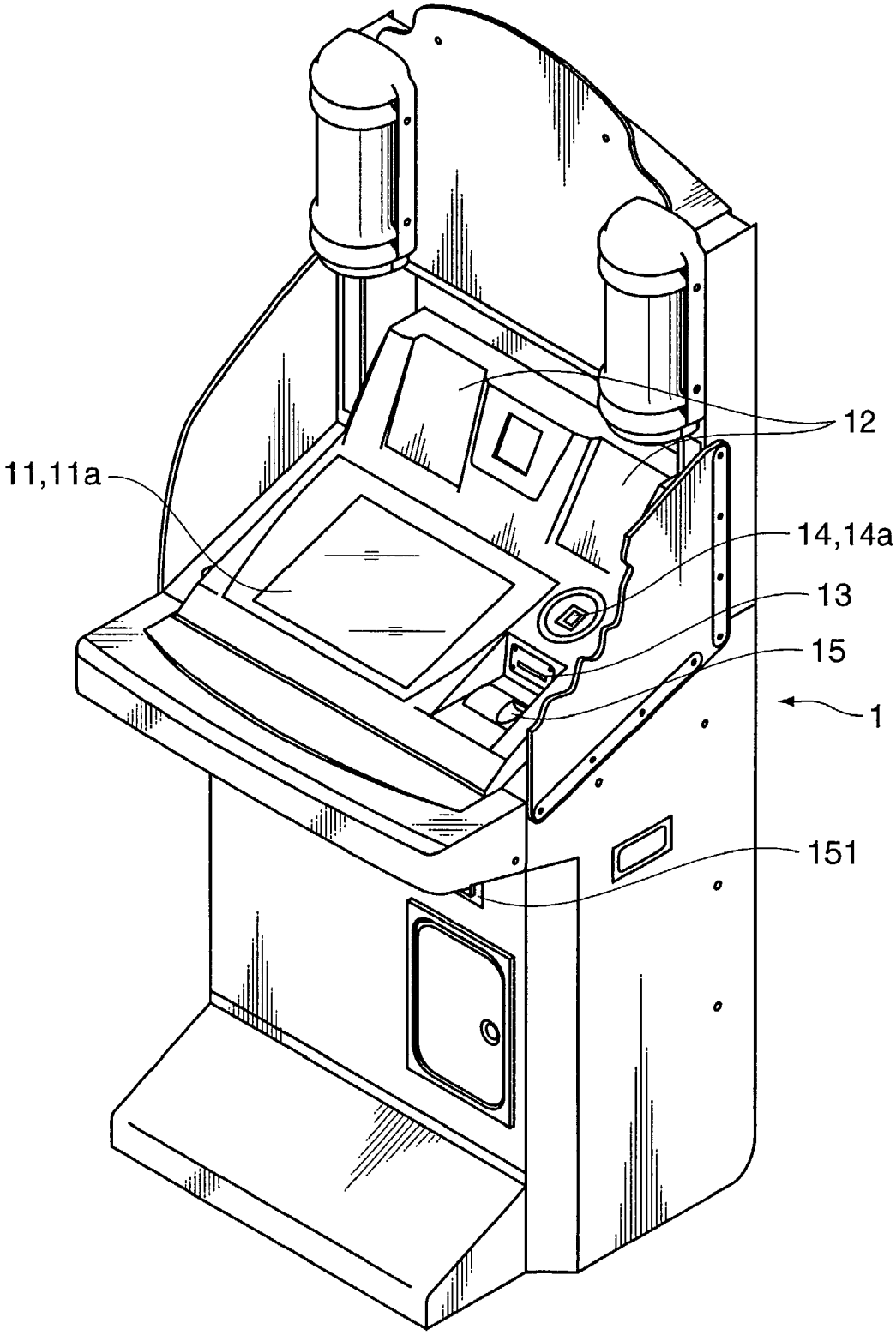
FIG. 1 is a perspective view showing the external appearance of one embodiment of the video game apparatus pertaining to the present invention.

FIG. 1 is a perspective view showing the external appearance of one embodiment of the video game apparatus pertaining to the present invention. In the description below, a commercial video game apparatus that incorporates a monitor is used as an example of the video game apparatus for purposes of explanation, but the present invention is not limited to this example, and may be applied in the same fashion to a home video game apparatus comprising a home video game machine connected to a household television, or to a personal computer that functions as a video game apparatus via the execution of a video game program.

Moreover, in this embodiment, the game played using the video game apparatus pertaining to the present invention is a mah-jongg game, wherein the player who operates the video game apparatus plays against players using other video game apparatuses and/or virtual players implemented by the CPU of the player's own apparatus. When the player is competing against players using other video game apparatuses, the game is played over a communication network 18 described below based on the transmission and receipt of data between the various video game apparatuses.

The video game apparatus 1 includes a monitor 11 that displays the game screens, a touch panel 11*a* that determines, based on the addresses of the buttons that prompt selections or the like that are shown on the game screens of the monitor 11 and the location at which pressure is applied by the player, which of the buttons was pressed, a speaker 12 that outputs sound, a card reader 13 that reads in information such as a user ID stored in a personal card, a fingerprint verification unit 14 that extracts characteristic data needed for personal authentication based on fingerprint information from a CCD camera described below, and a coin receiving unit 15 that receives coins inserted by the player. The characteristic data extracted by the fingerprint verification unit 14 is stored in a server not shown in the drawings via the network communication unit 18 described below and the network.

The monitor 11 is a thin-screen LCD display, for example, that displays images. The speaker 12 outputs prescribed messages or BGMs. The fingerprint verification unit 14 includes a CCD camera that performs imaging of the player's fingerprints. A different type of digital imaging device (such as a CMOS camera) may be used in place of the CCD camera 14*a*. The coin receiving unit 15 includes a coin ejection outlet 151 from which invalid inserted coins are ejected.

The personal card is a magnetic card or IC card that stores personal information such as a user ID. While not shown in the drawings, the card reader 13 enables information to be read from the personal card housed therein.

A controller 16 (see FIG. 2) comprising a microcomputer or the like that inputs detection signals from various components and outputs control signals to various components is located at an appropriate location in the video game computer 1.

Figure 2:
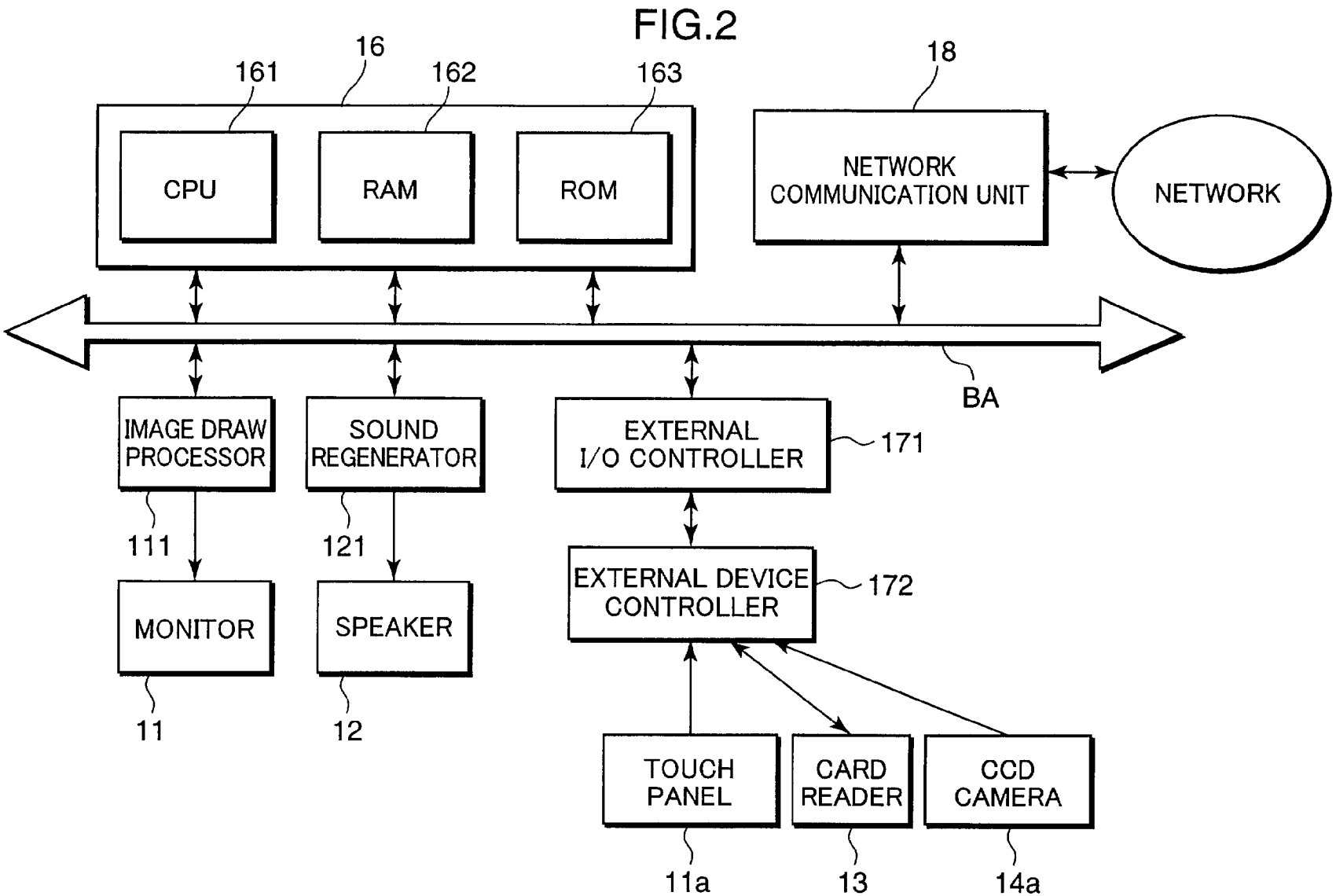
FIG. 2 is a hardware construction drawing showing one embodiment of the video game apparatus pertaining to the present invention.

FIG. 2 is a hardware construction drawing showing one embodiment of the video game apparatus pertaining to the present invention. The controller 16 controls the overall operation of the video game apparatus, and includes a central processing unit (CPU) 161, a RAM 162 that temporarily stores information during processing, and a ROM 163 in which prescribed image information as well as game programs and the like described below are stored beforehand.

The game progress control program pertaining to the present invention, which is stored in the ROM 163 together with the game programs, is loaded into the RAM 162, and the game progress control program loaded in the RAM 162 is executed in sequence by the CPU 161 while receiving operations carried out by the player via the touch panel 11*a*, thereby implementing various functions.

An external I/O controller 171 is located between the controller 16 and the detection units including the card reader 13, the touch panel 11*a* and the CCD camera 14*a*. It converts detection signals into digital signals for processing, as well as converts instruction information into control signals, outputs the digital signals or control signals to the controller 16 or to the various detection units, and conducts this signal processing and I/O processing using time division, for example. The external device controller 172 outputs control signals to the various detection units and inputs detection signals from the various detection units during their respective time division periods.

The image draw processor 111 displays prescribed images on the monitor 11 in accordance with image display instructions from the controller 16, and includes a video RAM. The sound regenerator 121 outputs to the speaker 12 prescribed messages or BGMs in accordance with instructions from the controller 16.

The touch panel 11*a* is a thin rectangular member that (i) comprises touch-sensitive elements composed of a linear transparent material that are aligned horizontally and vertically according to a prescribed pitch, and (ii) is covered by a transparent cover, and is affixed to the screen surface of the monitor 11. The touch panel 11*a* may comprise a public-domain technology. For example, a construction may be used in which pressure-sensitive conductive ink, such as an ink comprising thermoplastic resin in which conductive particles and non-conductive particles are dispersed together, is printed at corresponding positions on the facing sides of two opposing flexible rectangular film substrates, and the film substrates are then glued together. In addition, insulated lead wires leading from each pressure-sensitive conductive ink member protrude outside each film substrate. A prescribed voltage is applied to the lead wires for one film substrate, and a voltage detection circuit is connected to the lead wires for the other film substrate in such a manner that each lead wire can be recognized. The contact surfaces of the touch-sensitive conductive ink members of the glued-together film substrates have minute protrusions and indentations (caused by printing and by the presence of minute particles), and when pressure is applied to the film substrate surface by the player's finger (or by a pressure pen or the like), the effective relative areas of contact of the ink member surfaces changes, i.e., the resistance on the contact surfaces changes, and the voltage appearing on the side of the other set of lead wires can be detected in an analog fashion. In this way, the position at which pressure is applied can be detected. Consequently, it can be determined, based on the addresses of the buttons that prompt selections or the like that are shown on the game screens of the monitor 11 and the location at which pressure was applied by the player, which of the buttons was pressed.

Mah-jongg tile characters, background images, images for the various screens and the like are stored in the ROM 163. The mah-jongg tile characters and the like comprise an appropriate number of constituent polygons such that they can be drawn in a three-dimensional fashion, and the image draw processor 111 performs, based on image draw instructions from the CPU 161, processing for calculation to convert positions in a three-dimensional space into positions in a pseudo-three-dimensional space and light source calculation, as well as processing for the writing of the image data to be drawn to the video RAM based on these calculation results, i.e. processing for the writing (pasting) of texture data to the area of the video RAM specified using polygons, for example.

The relationship between the operation of the CPU 161 and the operation of the image draw processor 111 will now be described. The CPU 161 reads out from the ROM 163 images, sounds, control program data and game program data based on the operating system (OS) stored in the ROM 163, which may comprise either an internal ROM or part of an external, detachable apparatus. All or part of the read-out images, sounds, control program data and the like are saved in the RAM 162. Processing is then performed by the CPU 161 based on the control program and various data (image data such as polygons and texture for displayed objects and other character images, as well as sound data), as well as on detection signals from the detection units. In other words, based on detection signals and the like, the CPU 161 generates appropriate commands for the tasks of image draw and sound output. The image draw processor 111 performs calculation to determine the viewpoint, the positions of characters in a three-dimensional space (the same naturally applies in the case of a two-dimensional space) relative to this viewpoint and the light source, as well as processing for the generation and processing of sound data. Next, the CPU 161 executes, based on the results of the calculations above, processing to write to the video RAM the image data to be drawn. The image data written to the video RAM is supplied to the monitor 11 (after it is supplied to a D/A converter via an interface and converted into analog image signals), and is displayed as images on the screen thereof. At the same time, the sound data output from the sound regenerator 121 is output as sounds from the speaker 12 (after it is supplied to a D/A converter via an interface and converted into analog sound signals and amplified).

The image draw commands comprise image draw commands to draw three-dimensional images using polygons and image draw commands to draw normal two-dimensional images. These polygons are multi-sided two-dimensional images, and in this embodiment, triangular or rectangular shapes are used. The image draw commands to draw three-dimensional images using polygons comprise polygon vertex address data, texture address data indicating where the storage address of the texture data to be pasted to the polygon, color palette address data indicating the storage address of the color palette data indicating the color of the texture data, and brightness data indicating the brightness of the texture, all of which are read out from the ROM 163. One character (or object) comprises a number of polygons. The CPU 161 stores the three-dimensional space coordinate data for each polygon in the RAM 162. Where characters or the like are to be moved on the screen of the monitor 11, the processing described below is executed.

The CPU 161 sequentially seeks three-dimensional coordinate data for each polygon after movement and rotation thereof based on the three-dimensional coordinate data for the vertices of each polygon, as well as the data for the amount of movement and rotation of each polygon, all of which data is temporarily stored in the RAM 162. Of the three-dimensional coordinate data for each polygon sought in this fashion, the horizontal and vertical coordinate data is supplied to the image draw processor 111 as RAM 162 display area address data, i.e., as polygon vertex address data. The image draw processor 111 writes texture data indicated by the previously-assigned texture address data to the triangle or rectangle display area indicated by three or four items of polygon vertex address data. In this way, characters (or objects) comprising multi-sided polygons to which texture data has been pasted are displayed on the display screen of the monitor 11.

Among the various types of data stored in the ROM 163, data that can be stored on a detachable recording medium can be read using a driver of a hard disk drive, an optical disk drive, a flexible disk drive, a silicon disk drive, a cassette reader or the like, and in this case, the recording medium may comprise, for example, a hard disk, optical disk, flexible disk, CD, DVD, semiconductor memory or the like.

The network communication unit 18 enables the transmission and receipt of various types of event information generated during the playing of the mah-jongg game to and from a server (or other video game apparatus) over a network (such as the Internet).

The personal authentication method implemented by the video game apparatus 1 will now be described. Personal authentication confirms that the player who is recognized by the video game apparatus 1 (or the server not shown in the drawing that is connected via the network communication unit 18 and the network) is in fact the same player who is actually playing. Where a player wishes to play on the video game apparatus 1 for the first time, the card reader 13 reads out user ID data from the personal card inserted therein, the CCD camera 14*a* of the fingerprint verification unit 14 images the player's fingerprint, and characteristic data necessary for personal authentication is extracted using the fingerprint information from the CCD camera 14*a*. The user ID data and characteristic data are then transmitted to the server not shown in the drawing via the network communication unit 18 and the network, and are stored in the server. The player is thereby registered with the server. Where a player already registered with the server wishes to play on the video game apparatus 1, the card reader 13 reads out user ID data from the personal card inserted therein, the CCD camera 14*a* of the fingerprint verification unit 14 images the player's fingerprint, and characteristic data necessary for personal authentication is extracted using the fingerprint information from the CCD camera 14*a*. The user ID data and characteristic data are then transmitted to the server not shown in the drawing via the network communication unit 18 and the network, and the server determines whether or not the characteristic data corresponding to the user ID stored therein is identical to the transmitted characteristic data. If the determination is affirmative, play is permitted, while if the determination is negative, play is denied (for example, an error message is displayed on the monitor of the video game apparatus 1 and the user is prompted to re-attempt fingerprint verification).

Figure 3:
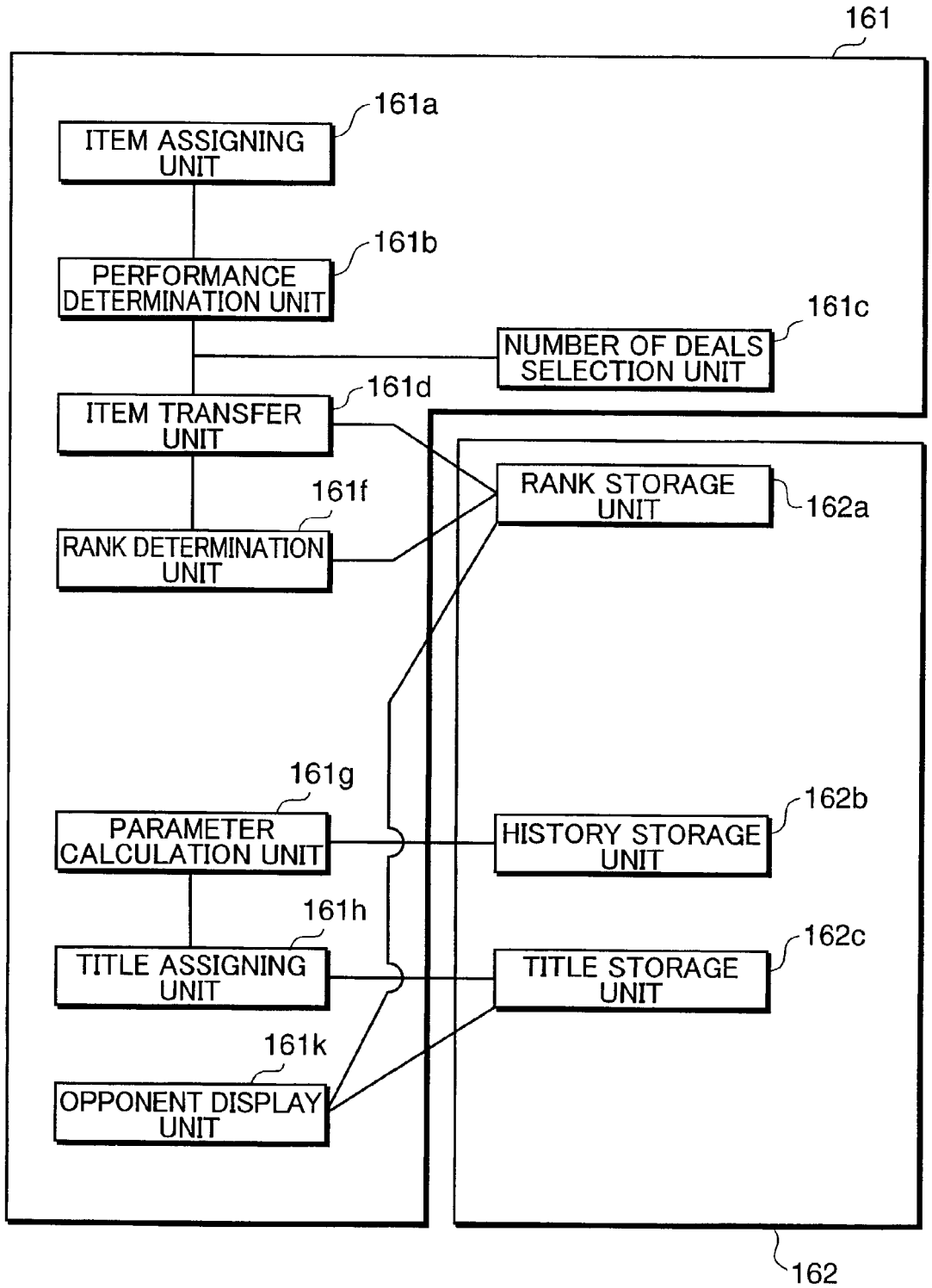
FIG. 3 is a function block diagram pertaining to the controller 16.
Figure 7A:
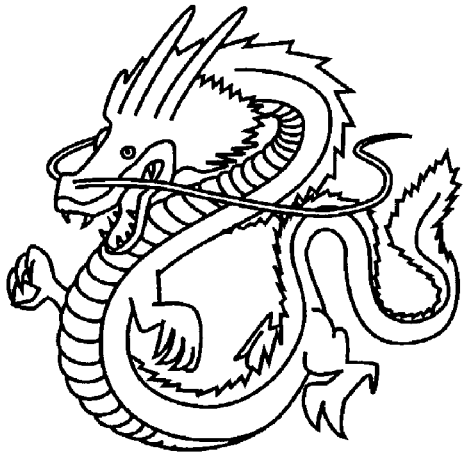
FIGS. 7A to 7D show the characters that are displayed on the game screens or the like in association with the respective titles.
Figure 7B:
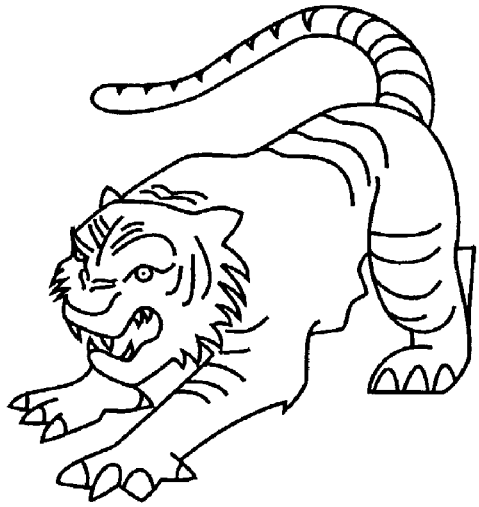
Figure 7C:
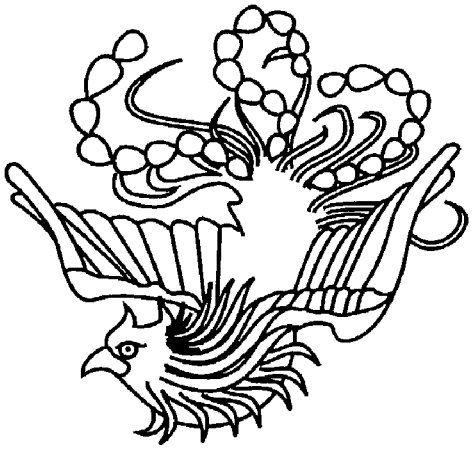
Figure 7D:
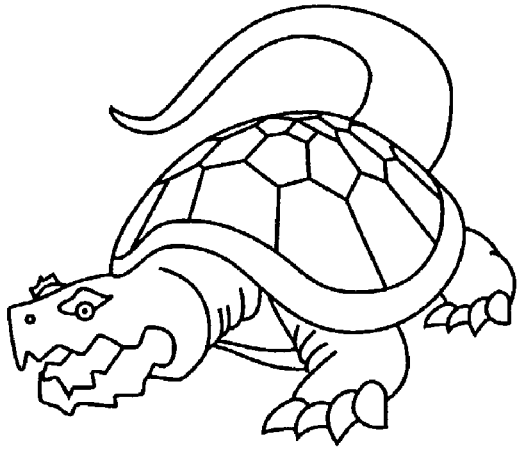

FIG. 3 is a function block diagram pertaining to the controller 16. The CPU 161 of the controller 16 includes an item assigning unit 161*a* (equivalent to item assigning means) that virtually assigns a prescribed number of items to players who satisfy prescribed conditions, a number of deals selection unit 161*c* (equivalent to number of deals selection means) that, when a game is begun, displays multiple options for the number of deals and receives selection input from the player, a performance determination unit 161*b* (equivalent to performance determination means) that, when a game ends, determines the order in which the players finished in that game, an item transfer unit 161*d* (equivalent to item transfer means) that, based on the results of the determination by the performance determination unit 161*b* and the number of deals selected by the number of deals selection unit 161*c*, transfers among players a prescribed number of items from among the items virtually possessed by the players, a rank determination unit 161*f* (equivalent to rank determination means) that determines a rank indicating the level of a player's skill at mah-jongg based on the number of items virtually possessed by the player, a parameter calculation unit 161*g* (equivalent to parameter calculation means) that calculates parameters indicating the characteristics of each player's games based on the history data stored in the history storage unit 162*b* described below, a title assigning unit 161*h* (equivalent to title assigning means) that assigns a title applicable during games to each player based on the calculated parameters, and an opponent display unit 161*k* (equivalent to opponent display means) 161*k* that displays on a game screen the rank and title of each opponent.

The RAM 162 of the controller 16 includes a rank storage unit 162*a* (equivalent to rank storage means) that associates a number of items and a rank with each player and stores them in memory, a history storage unit 162*b* (equivalent to history storage means) that stores past game history data for each player, and a title storage unit 162*c* (equivalent to title storage means) that associates the title assigned by the title assigning unit 161*h* with each player and stores it in memory.

The number of deals selection unit 161*c* displays a table selection screen (see FIG. 9) when a game begins and, by receiving selection input from the player and selecting a table, determines whether a 'One deal', 'One round' or 'Two rounds' game will be played, and selects the opponents. However, the tables selectable by the player are preset in accordance with the rank of the player. In this embodiment, there are tables at which players who are at or above '1$^{st}$ degree master' rank play (this type of game is called a 'master level game') as well as tables at which players who are at or below 'Grade 1' rank play (this type of game is called a 'novice level game'). If the player is at or above '1$^{st}$ degree master' rank, he is permitted to select a master level game table, while if the player is at or below Grade 1 rank, he is permitted to select a novice level game table.

The item assigning unit 161*a* virtually assigns items ('dragon chips' in this embodiment) to players who satisfy prescribed conditions, increases or reduces the number of points virtually possessed by the players, and associates with each player and stores in the rank storage unit 162*a* the number of items and points corresponding to each player. The points virtually possessed by the players are, like the dragon chips, a type of item. The method by which the number of points is increased or decreased and the conditions for the assignment of items will now be described specifically. During the game, when a player wins, the number of points virtually possessed by the player is increased by a prescribed number, and when the player loses on 'furikomi', i.e., on his own discard, the number of virtually possessed points is reduced by a prescribed amount. For example, where the player wins, the number of points obtained for winning is increased by 20 points for every 1000 points possessed. Where the player loses on his own discard, the number of points possessed by the player is reduced by 10 points for every 1000 points in his score. Where the number of points is 1000 or higher, three items, i.e., dragon chips, are virtually assigned. Hereinafter the term 'furikomi' is used to mean the condition that a player loses on his own discard and an opponent wins by gaining the discarded tile.

When the game comprising the number of deals selected by the number of deals selection unit 161*c* has been completed, the performance determination unit 161*b* determines the order of the players' finish, with the first-place finisher being the player who virtually possesses, as counters, the largest number of points. However, the number of points possessed as counters by each player when the game begins (referred to as the 'starting points') is identical. For example, the starting points figure is 15,000 points in a 'One deal' game, 20,000 points in an 'One round' game, and 25,000 in a 'Two rounds' game.

After the order of finish of the players in the game is determined by the performance determination unit 161*b*, the item transfer unit 161*d* transfers among the players a prescribed number of items from among the items virtually possessed by the players, based on the results of the determination by the performance determination unit 161*b* and the number of deals selected by the number of deals selection unit 161*c*. Specifically, in a 'One deal' game, dragon chips are not transferred, in a 'One round' game, one dragon chip is transferred from the fourth-place finisher to the first-place finisher, and in a 'Two rounds' game, two dragon chips are transferred from the fourth-place finisher to the first-place finisher and one dragon chip is transferred from the third-place finisher to the second-place finisher. In addition, where a virtual tournament or the like is held, the number of dragon chips transferred can be increased beyond the numbers described above, thereby whetting the player's desire to participate in the tournament. Furthermore, the item transfer unit 161*d* stores the number of dragon chips in rank storage means 162*a* described below on a continuously updated basis.

The rank determination unit 161*f* determines a rank indicating the level of the player's skill at mah-jongg based on the number of items virtually possessed by the player. The method used to determine this rank will now be described in specific terms with reference to FIGS. 4 and 5.

FIG. 4 is a table showing the conditions for the assignment by the rank determination unit 161*f* of a rank (Grade 1 through Grade 10) indicating the level of the player's skill at mah-jongg. The player is assumed to have a rank of Grade 10 when he plays the game for the first time. The rank becomes Grade 9 when the player's number of points is between 100 and 199, for example. As the player's point total rises (or falls) his rank is increased (or decreased) accordingly, such that where the player possesses between 900 and 999 points, he becomes a Grade 1 player, for example. Once the player reaches 1000 points, he becomes a 1$^{st}$ degree master.

FIG. 5 is a different table showing the conditions for the assignment by the rank determination unit 161*f* of a rank (1$^{st}$ degree master through 8$^{th}$ degree master) indicating the level of the player's skill at mah-jongg. As described above, the item assigning unit 161*a* virtually assigns three items, i.e., dragon chips, to a player who attains 1000 points. Thereafter, the number of dragon chips virtually possessed by each player fluctuates depending on the transfers among the players of their dragon chips based on the results of the determinations by the performance determination unit 161*b* and the number of deals selected by the number of deals selection unit 161*c*, and is stored on a continuously updated basis in the rank storage means 162*a* described below. For example, a player who has five or more but fewer than 10 dragon chips is deemed a 2$^{nd}$ degree master. As the player's number of dragon chips rises (or falls), his rank is increased (or decreased) accordingly, and a player who possesses 46 or more dragon chips is deemed an 8$^{th}$ degree master. Where a player who has attained 1$^{st}$ degree master rank has no dragon chips (or a negative number thereof) as a result of game play, he is demoted to Grade 1 rank.

In other words, the rank determination unit 161*f* determines the appropriate rank with reference to the level tables shown in FIGS. 4 and 5, based on the number of points determined by the item assigning unit 161*a* and the number of items determined by the item assigning unit 161*a* and the item transfer unit 161*d*.

When a player is determined by the rank determination unit 161*f* to be at 1st degree master rank, the parameter calculation unit 161*g* calculates parameters indicating the characteristics of the player's games based on the history data stored in the history storage unit 162*b* described below. These parameters include the 'win ratio', 'furikomi ratio', 'average number of dora tiles (or hereinafter referred also as special tiles) held on win' and 'average number of exponentials held on win'. Note that the meaning of terms in Mah-jongg can be found in Mah Jong—Modern Japanese Rules, v1.53 at http://www.delfosse.com/mahjong.html (Win ratio)=(Cumulative number of deals won)/(Cumulative number of deals played)

(Furikomi ratio)=(Cumulative number of furikomi losses)/(Cumulative number of deals played)

(Average number of dora tiles held on win)=(Cumulative number of dora tiles held when winning a deal)/(Cumulative number of deals won)

(Average number of exponentials held on win)=(Cumulative number of exponentials when winning a deal)/(Cumulative number of deals won)

The cumulative number of deals won, cumulative number of furikomi losses, cumulative number of deals played, cumulative number of dora tiles held when winning a deal, cumulative number of exponentials when winning a deal and cumulative number of deals won, which are used in the formulae described above, are associated with each player and stored in the history storage unit 162*b* described below.

When a player is determined by the rank determination unit 161*f* to be at 1st degree master rank, a title applicable during games is virtually assigned to the player and associated with the player by the title assigning unit 161*h* based on the parameters calculated by the parameter calculation unit 161*g*, and is stored in the title storage unit 162*c*.

FIG. 6 is a table that describes the conditions for title assignment by the title assigning unit 161*h*. As shown in FIG. 6, a level is set in association with a numerical value for each parameter. For example, where the win ratio is 0.31, the win ratio level is 6, while where the 'furikomi' ratio is 0.125, the 'furikomi' ratio level is 7. The title assigning unit 161*h* first determines the win ratio level, 'furikomi' ratio level, average number of 'dora' tiles and average number of exponentials based on the table shown in FIG. 6. The title corresponding to the highest-level parameter is then assigned. Where the win ratio level is the highest, the player is determined to be a 'quick win' type of player and is assigned the title of 'phoenix'. Where the 'furikomi' ratio level is the highest, the player is determined to be a 'defense-first' type player and is assigned the title of 'turtle'. Where the average number of 'dora' tiles level is highest, the player is determined to be a luck-dependent type player and is assigned the title of 'dragon'. Where the average number of exponentials level is highest, the player is determined to be an attack-minded player and is assigned the title of 'tiger'. Each title indicates the name of a character that conveys an image of the player's characteristic game style (such as a 'quick win' approach).

FIG. 7 shows the characters that are displayed on the game screens or the like in association with the various titles assigned by the title assigning unit 161*h*. In the drawing, FIG. 7A is an image drawing of the 'dragon' character corresponding to the 'dragon' title, FIG. 7B is an image drawing of the 'tiger' character corresponding to the 'tiger' title, FIG. 7C is an image drawing of the 'phoenix' character corresponding to the 'phoenix' title, and FIG. 7D is an image drawing of the 'turtle' character corresponding to the 'turtle' title.

The rank storage unit 162*a* associates with each player the number of items, which is assigned by the item assigning unit 161*a* and changed by the item transfer unit 161*d*, as well as the rank determined by the rank determination unit 161*f*, and stores these values in memory.

The history storage unit 162*b* stores as past game history data for each player the cumulative number of wins, i.e., the cumulative number of deals won by the player, the cumulative number of 'furikomi', i.e., the cumulative number of times the player has lost on his own discard, the cumulative number of deals played, the cumulative number of 'dora' tiles, i.e., the cumulative number of 'dora' tiles contained in the player's hand when the player has won, the cumulative number of exponentials, i.e. the cumulative number of 'fan' contained in the player's hand when the player has won, and the cumulative number of wins, i.e. the cumulative number of wins that have occurred.

The title storage unit 162*c* associates with each player and stores the parameter values calculated by the parameter calculation unit 161*g* and the title that is assigned to the player by the title assigning unit 161*h*.

Figure 8:
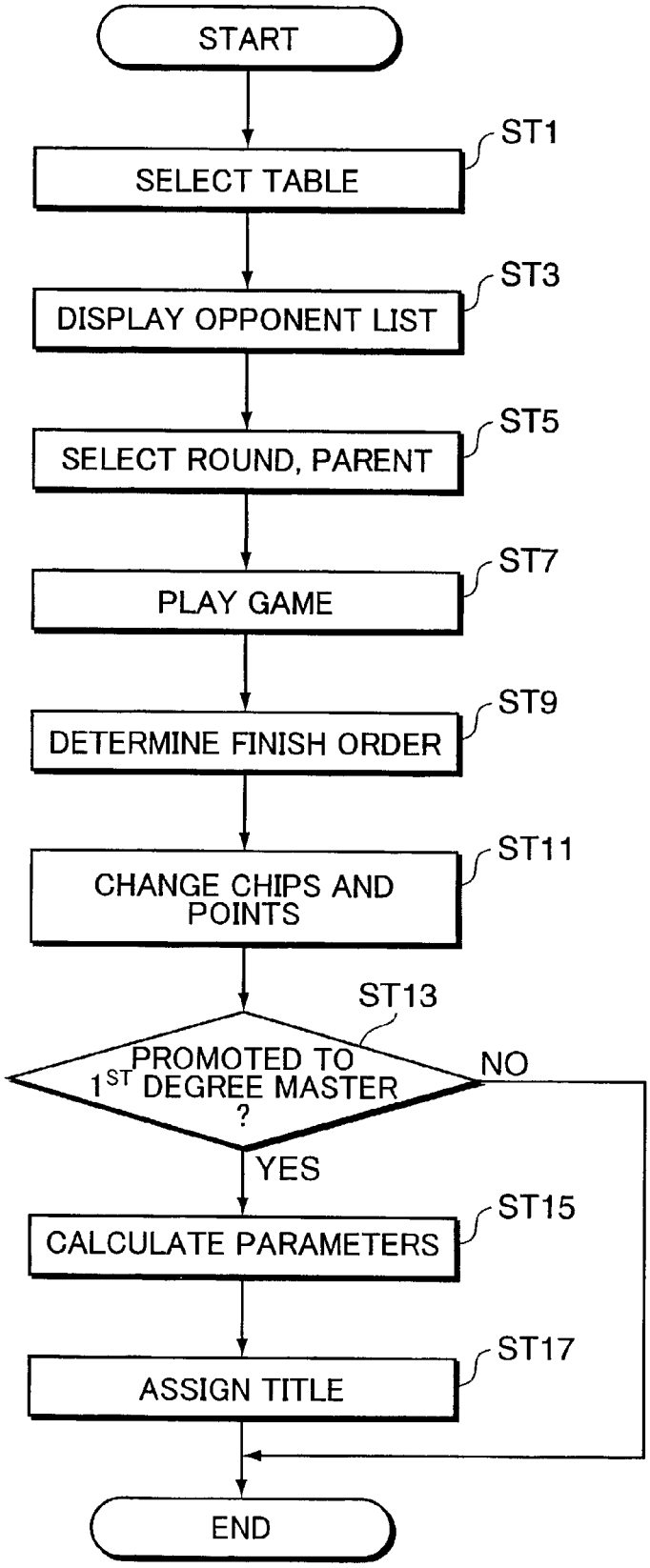
FIG. 8 is an example of a flow chart showing the operations performed by the video game apparatus 1 pertaining to the present invention.

FIG. 8 is an example of a flow chart showing the operations performed by the video game apparatus 1 pertaining to the present invention. It is assumed in this example that a personal card has been inserted in the card reader 13, the player's fingerprint has been imaged by the CCD camera 14*a* of the fingerprint verification unit 14, characteristic data needed for personal authentication has been extracted by the fingerprint verification unit 14 using the fingerprint information from the CCD camera 14*a*, the user ID data stored in the personal card and the characteristic data has been extracted by the fingerprint verification unit 14 and sent to a server that is connected via the network communication unit 18 and the network and is not shown in the drawings, and personal authentication has been approved by the server.

Figure 9:
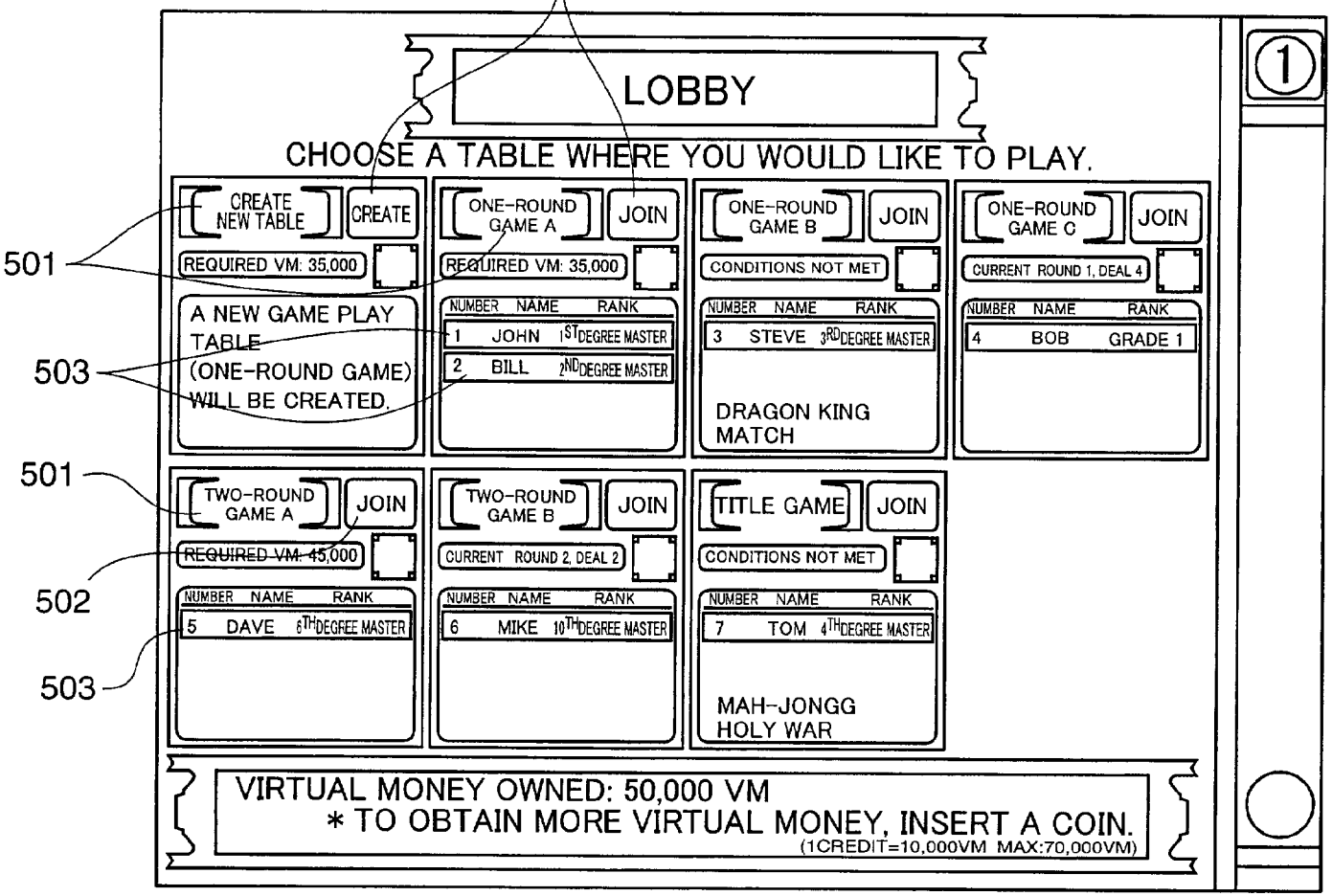
FIG. 9 is a screen drawing of a table selection screen.

First, the table selection screen shown in FIG. 9 is displayed and selection input is received from the player by the number of deals selection unit 161*c* in order to select a table from among the multiple table options, and either 'One deal', 'One round', or 'Two rounds' is selected (step ST1). The opponent display unit 161*k* then displays the opponent display screen shown in FIG. 10, which shows the opponents for the table selected in step ST1, and after a prescribed period of time (or after the player performs a prescribed operation), one of the rank display screens shown in FIGS. 11 and 12, which display rank and other information regarding the current players, is displayed (step ST3). The round and dealer are then determined (step ST5), the game is begun in step ST7, and the game screen is displayed (see FIGS. 17 and 18). When the game is completed, the players' order of finish in the game is determined by the performance determination unit 161*b* and the order display screen is displayed (FIG. 19).

The number of points is then increased or decreased by the item assigning unit 161*a*, the items virtually possessed by the players are transferred among the players based on the results of the determination by the performance determination unit 161*b* and the number of deals selected by the number of deals selection unit 161*c* (step ST11), and the item display screen is displayed. The rank determination unit 161*f* then determines a rank indicating the level of the player's skill at mah-jongg based on the number of items and points virtually possessed by the player, and determines whether or not the player's rank has risen to $1^{st}$ degree master (step ST13). If the player's rank has not risen to $1^{st}$ degree master, the item display screen (see FIG. 20) that shows the current number of items and the like is displayed, and the routine ends.

If the player's rank has risen to $1^{st}$ degree master, the parameters indicating the characteristics of the player's games are calculated by the parameter calculation unit 161*g* (step ST15). A title applicable during games is then virtually assigned by the title assigning unit 161*h* in step ST17 to the player based on the parameters calculated by the parameter calculation unit 161*g*. After the item display screen (see FIG. 20) is displayed for a prescribed period of time, the rank promotion screen (see FIG. 21) is displayed, whereupon the routine ends. Either before the game (until the execution of step ST5) or after the game (during or after the execution of step ST9), the personal information screens shown in FIGS. 13–16 can be displayed by pressing a prescribed button on the game screen.

The game screens displayed on the monitor 11 will now be described with reference to the flow chart shown in FIG. 8, using the screen drawings shown in FIGS. 9–21. FIG. 9 is a screen drawing of the table selection screen displayed in step ST1 of the flow chart shown in FIG. 8. A table name 501 that indicates one of either 'One deal, One round' or 'Two rounds', a 'Join/Create' button 502 that is pressed when the player wishes to join the indicated table, and player information 503 that provides the name, rank and the like of the existing players at the indicated table, are shown for each table in two rows in the center of the screen. In this embodiment, players are currently being recruited for two tables: the second table from the left in the top row having a table name 501 of 'One-round Game A', and the table at the left edge of the bottom row having the table name 501 of 'Two-round Game A'. When the 'Join/Create' button 502 for the former table is pressed, a one-round game is selected, while when the 'Join/Create' button 502 for the latter table is pressed, a two-round game is selected. If the 'Join/Create' button 502 for the table at the left edge of the top row having the table name 501 of 'Create New Table' is pressed, the player creates a table for a new 'One round' game, for which other players can be recruited. In this case, a one-round game is selected.

Figure 10:
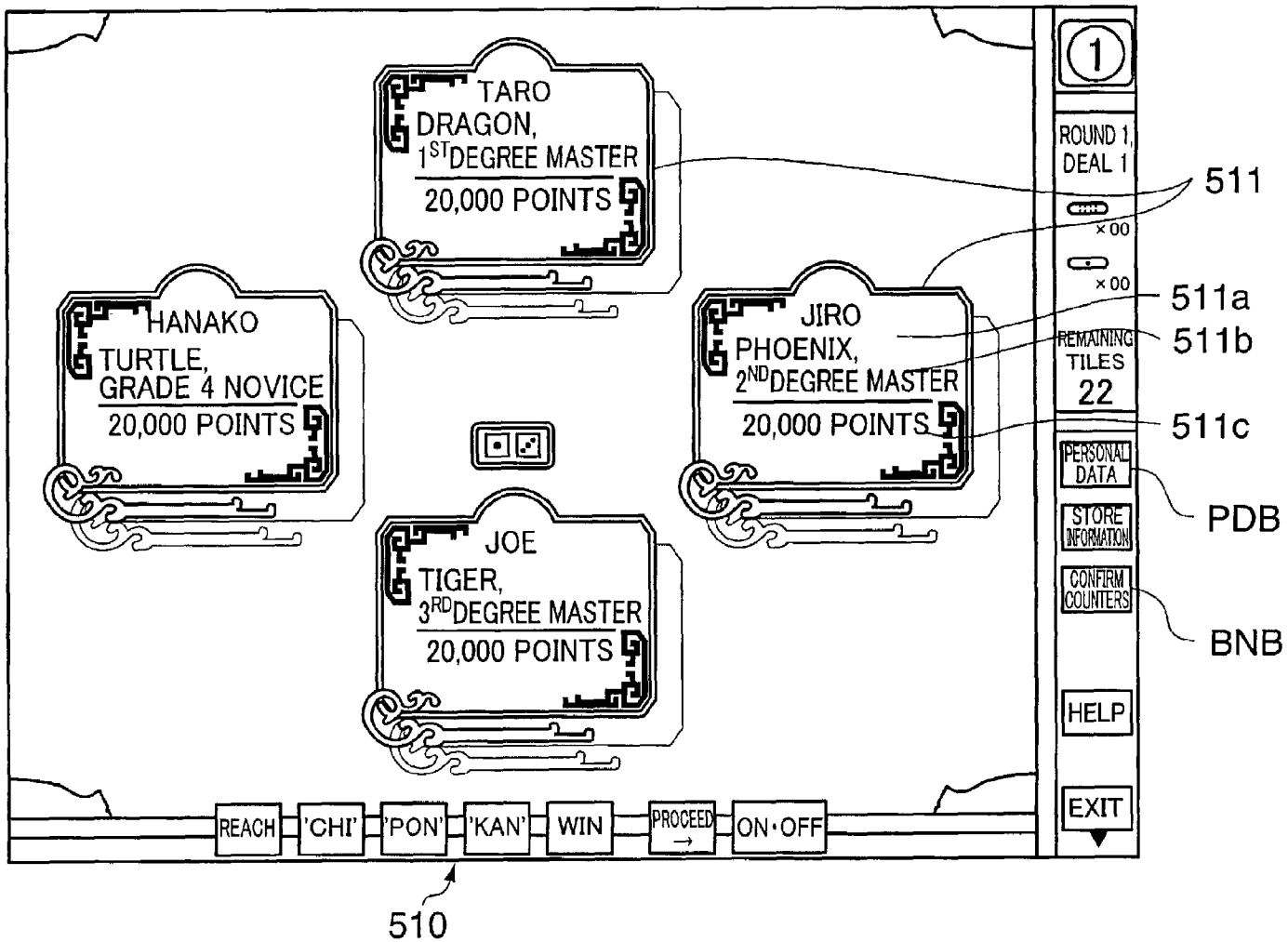
FIG. 10 is a screen drawing of a opponent display screen.

FIG. 10 is a screen drawing of the opponent display screen shown in step ST3 of the flow chart shown in FIG. 8. Displayed in the opponent display screen 510 is player information 511 that includes a nickname 511*a*, a title and rank 511*b*, and points possessed 511*c* regarding each player. The player information 511 at the bottom of the screen is the player information for the player using the video game apparatus 1, the player information 511 at the top of the screen is player information for the player sitting opposite this player (TOIMEN: the opponent who sits across from the player in a virtual sense and plays two turns before the player), the player information 511 at the left of the screen is player information for the opponent who plays just before the player (KAMICHA: the opponent who sits to the left of the player in a virtual sense and plays one turn before the player), and the player information 511 at the right of the screen is player information for the opponent who plays just after the player (SHIMOCHA: the opponent who sits to the right of the player in a virtual sense and plays one turn after the player). Because the title and the rank of each opponent can be seen from the opponent display screen 510, the skill level and game style of each opponent can be learned and the player can enjoy the task of plotting his own strategy based on his opponents. For example, where an opponent has a high rank (indicating that he is a strong player) and a title of 'phoenix' (indicating that he tends to go for a quick win), the player can design a strategy to compete with the opponent by speeding up the development of his own hand.

Figure 11:
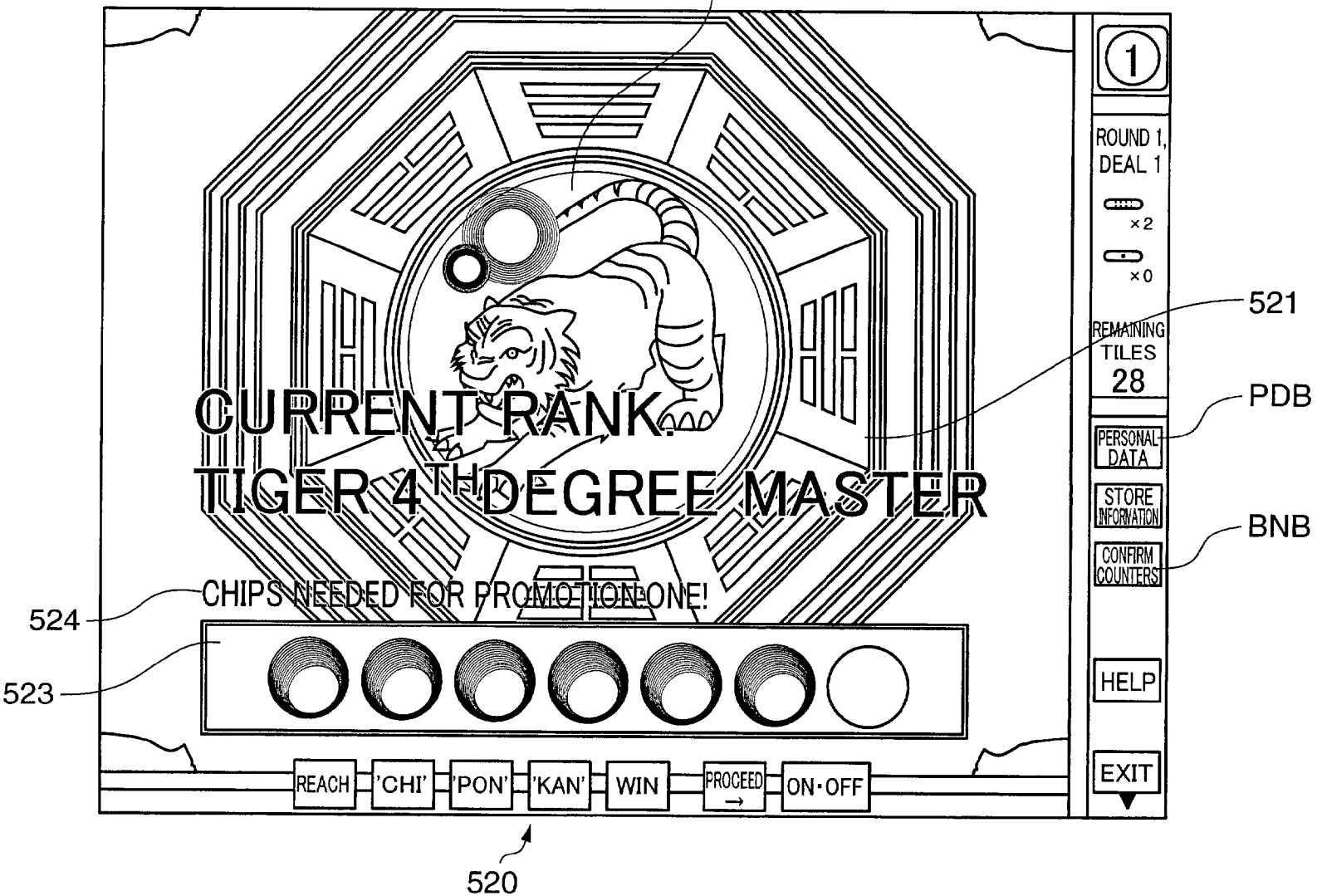
FIG. 11 is a screen drawing of a rank display screen (in the case of a master level game)

FIG. 11 is a screen drawing of the rank display screen displayed in step ST3 of the flow chart shown in FIG. 8 (in the case of a master level game). Displayed in approximately the center of the rank display screen 520 are a character message 521 indicating the current title and rank of the player (here, the message is 'Currently Turtle $4^{th}$ Degree Master'), a character image 522 corresponding to the character message 521, a chip display area 523 that indicates the number of dragon chips currently possessed by the player, and a character message 524 that indicates the condition required for the player to rise in rank. Here, it can be seen that the player currently possesses six dragon chips, and that he can rise to the rank of $5^{th}$ degree master by earning one more dragon chip. Similarly, it can seen that if he loses six dragon chips, he will be demoted to a lower rank. Accordingly, because the condition for a promotion or demotion in rank can be clearly understood in terms of a required number of dragon chips in this way, the player can clearly establish a goal for the game, thereby making the game more interesting.

Figure 12:
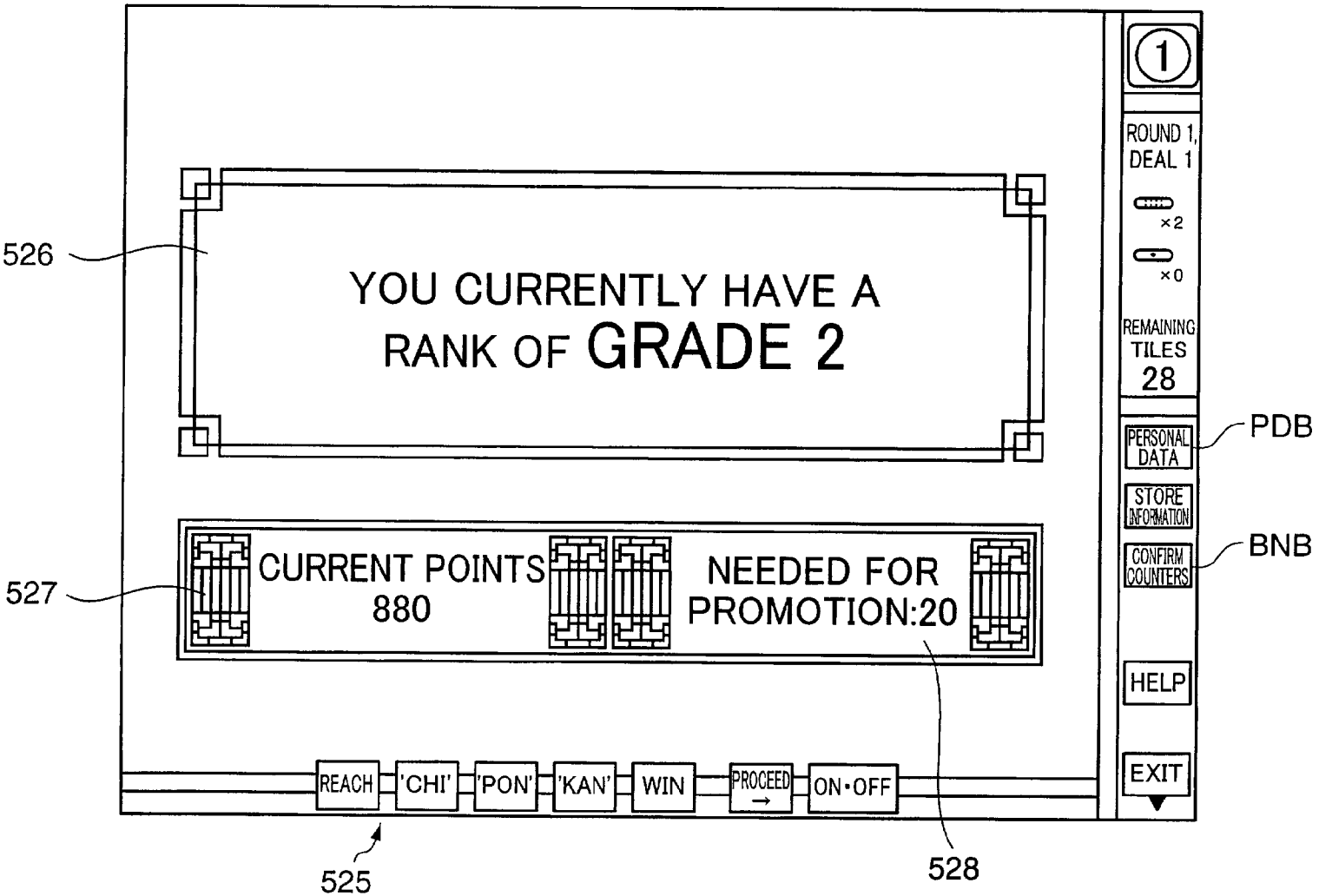
FIG. 12 is a screen drawing of a rank display screen (in the case of a novice level game)

FIG. 12 is a screen drawing of the rank display screen displayed in step ST3 of the flow chart shown in FIG. 8 (in the case of a novice level game). Displayed in approximately the center of the rank display screen 525 are a character message 526 indicating the current title and rank of the player (here, the message is 'Grade 2'), a point display area 527 that indicates the number of points currently possessed by the player, and a character message 528 that indicates the condition required for the player to rise in rank. Here, it can be seen that the player currently possesses 880 points, and that he can rise to the rank of Grade 1 by earning 20 additional points. Similarly, it can be seen that if he loses 81 points, he will be demoted to Grade 3 rank. Accordingly, because the condition for a promotion or demotion in rank can be clearly understood in terms of a required number of points, the player can clearly establish a goal for the game, thereby making the game more interesting.

FIGS. 13–16 are screen drawings of the player personal information screens displayed by pressing a prescribed button (personal data button PDB described below) in a game screen before the game is played (until the execution of step ST5 in the flow chart shown in FIG. 8) or after the game is completed (during or after the execution of step ST9 in the flow chart shown in FIG. 8). The personal information screens include a general personal information screen 530, which is a screen that comprehensively presents the player's personal information, a winning hand distribution screen 540 that shows the distribution of the player's wining hands, a game record screen 550 that indicates results achieved by the player in past games, and a dragon chips screen 560 that indicates the number of dragon chips or the like possessed by the player. FIGS. 13–16 are screen drawings of the general personal information screen 530, the winning hand distribution screen 540, the game record screen 550 and the dragon chips screen 560, respectively.

Displayed in each of the general personal information screen 530, the winning hand distribution screen 540, the game record screen 550 and the dragon chips screen 560 are a personal data button PDB that is located in roughly the center of the right edge of the screen and is pressed in order to display the player's personal information, a counter confirmation button BNB that is located below the personal data button PDB and is pressed in order to display the number of counters possessed by all four game competitors including the player, a total information button TIB that is located to the left of the personal data button PDB and is pressed in order to display the general personal information screen, which is a screen that comprehensively presents personal information regarding the player, a winning hand distribution button RDB that is pressed in order to display the winning hand distribution screen, which is a screen that indicates the distribution of the player's winning hands, a game record button FRB that is pressed in order to display the game record screen, which is a screen that indicates the results attained by the player in past games, a dragon chips button HDB that is pressed in order to display the dragon chips screen, which is a screen that indicates the number of dragon chips and the like possessed by the player, and a 'Back' button BB that is pressed in order to return to the original screen.

Figure 13:
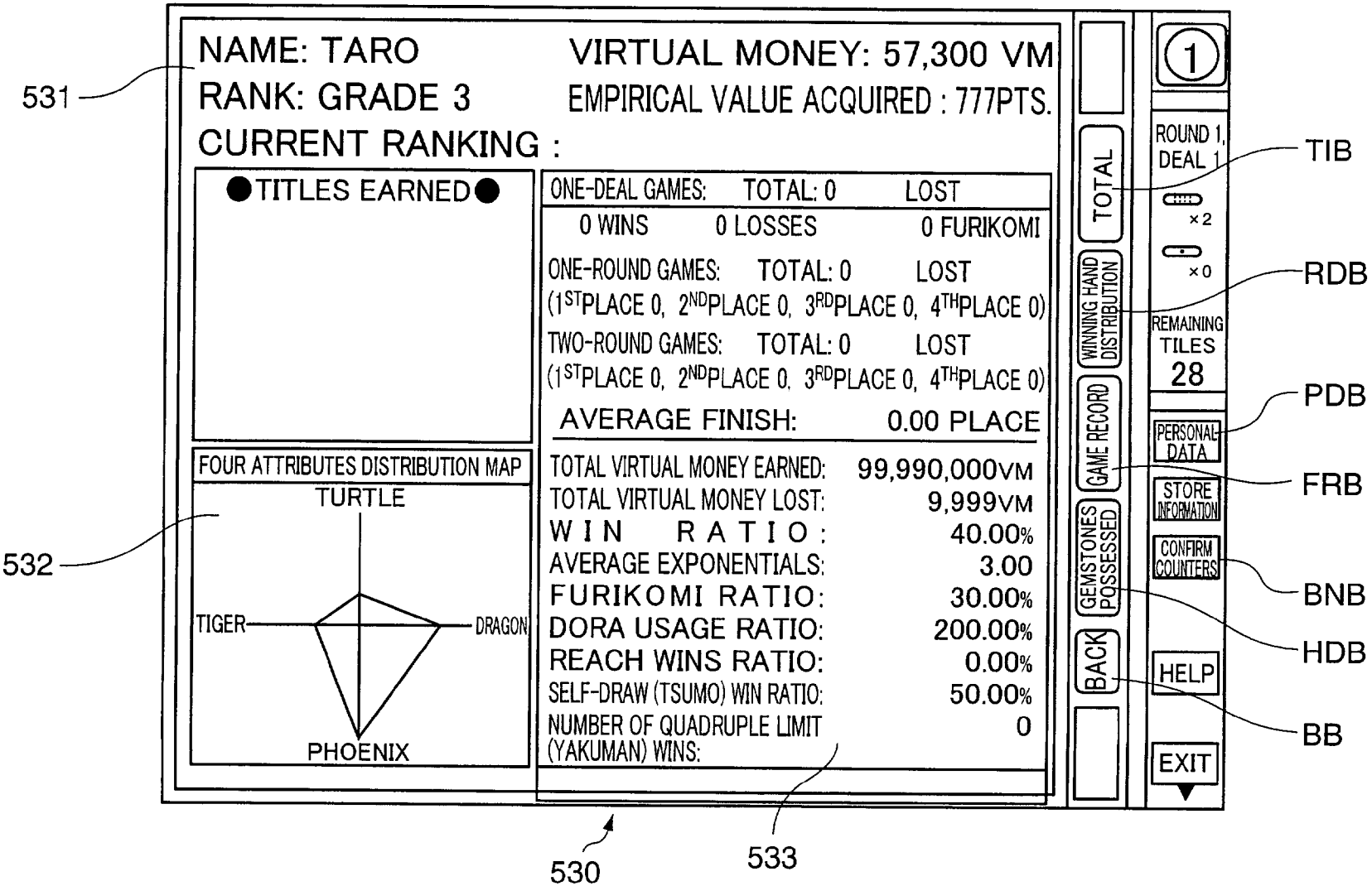
FIG. 13 is a screen drawing of a general personal information screen.

Displayed in the general personal information screen 530 shown in FIG. 13 are a player nickname 531 located at the upper left of the screen, a radar chart 532 that is located at the bottom left of the screen and shows the level of each of the four parameters (win ratio, 'furikomi' ratio, average number of 'dora' tiles and average number of exponentials) indicating the player's characteristics, and a data chart 533 that is located at the bottom center of the screen and shows the player's past game results.

Displayed in table form in the winning hand distribution screen 540 shown in FIG. 14 are hand names 541 comprising the names used to describe the various winning hands, number of hands 542 comprising the number of times that the corresponding hand has represented the player's winning hand, and hand probability 543 that comprises the percentage probability that the player won with that hand, determined by dividing the number of times the player won with that hand by the player's total number of winning hands.

Figure 15:
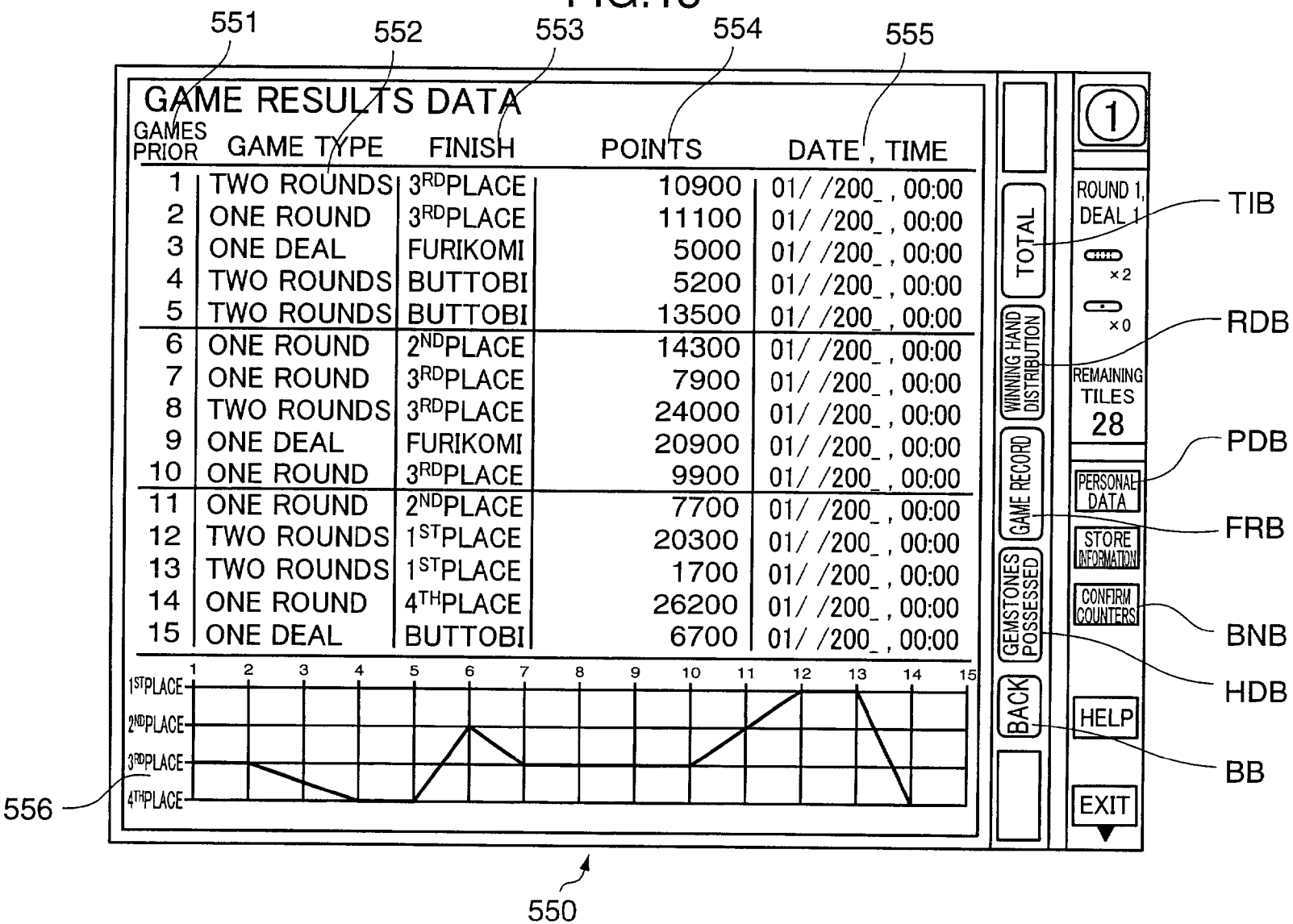
FIG. 15 is a screen drawing of a game record screen.

Displayed in the game record screen 550 shown in FIG. 15 are the results for the player's most recent 15 games, which are displayed in table form at the top of the screen, and a line chart 556 that is located at the bottom of the screen and shows the player's relative ranking in each of those 15 games. The game results include such information as the game number 551 that indicates how many games prior to the current game the past game was played, the type of game 552 that indicates whether the past game was a 'One round' game, an 'One round' game or a 'Two rounds' game, and game results 553 that indicate the results of that game.

Figure 16:
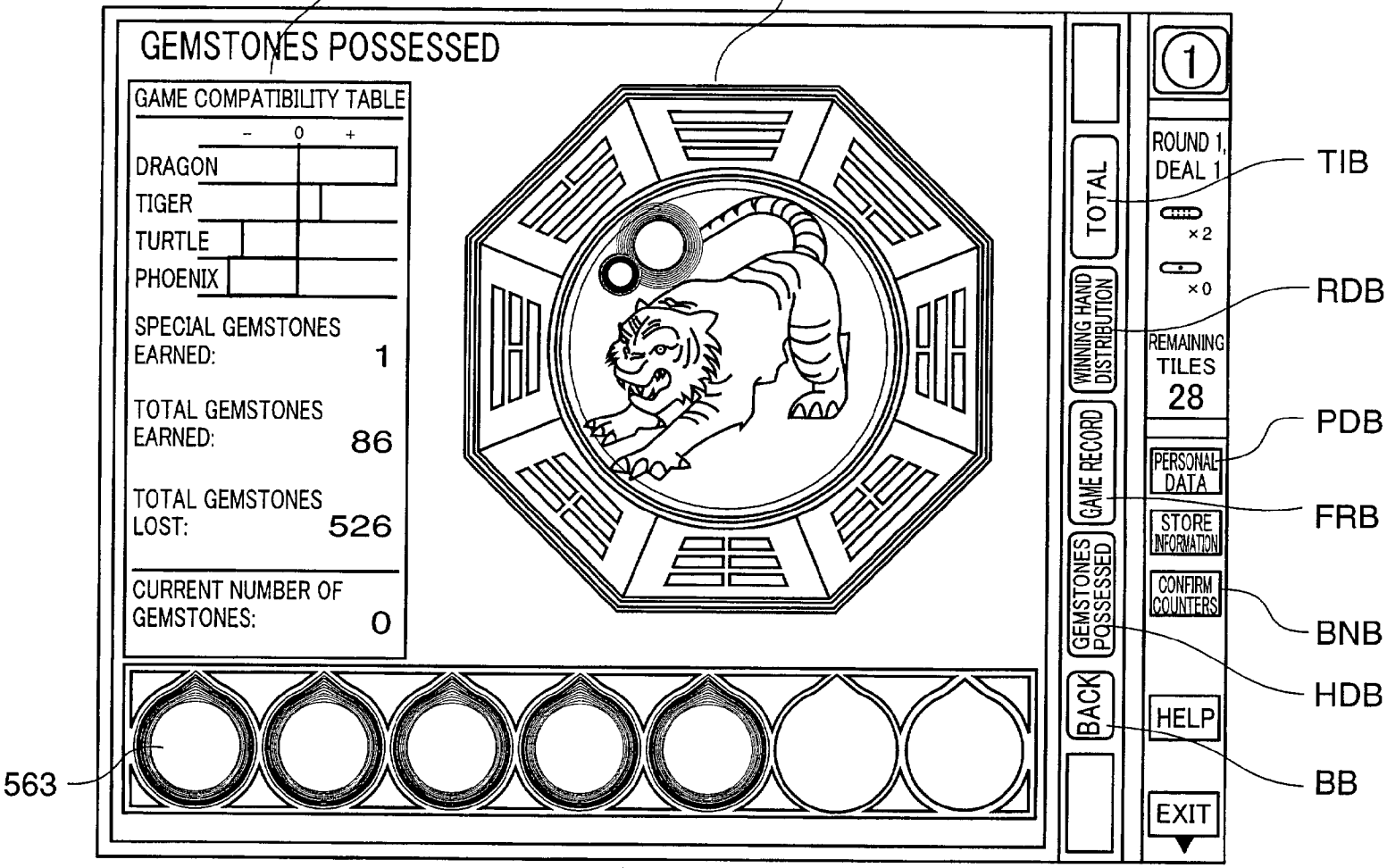
FIG. 16 is a screen drawing of a dragon chips screen.

Displayed in the dragon chips screen 560 shown in FIG. 16 are various types of data 561 that include (i) the cumulative number of gemstones earned, which represents the total number of dragon chips earned by the player in past games, and (ii) the cumulative number of lost gemstones, which represents the total number of dragon chips lost by the player in past games, a character image 562 that corresponds to the title that indicates the player's characteristics, and a number of chips required image 563 that indicates the number of dragon chips required for the player to rise to the next higher rank.

The data required in order to display the images shown in FIGS. 13–16 is stored in the RAM 162 shown in FIG. 2 on an updatable basis.

Figure 17:
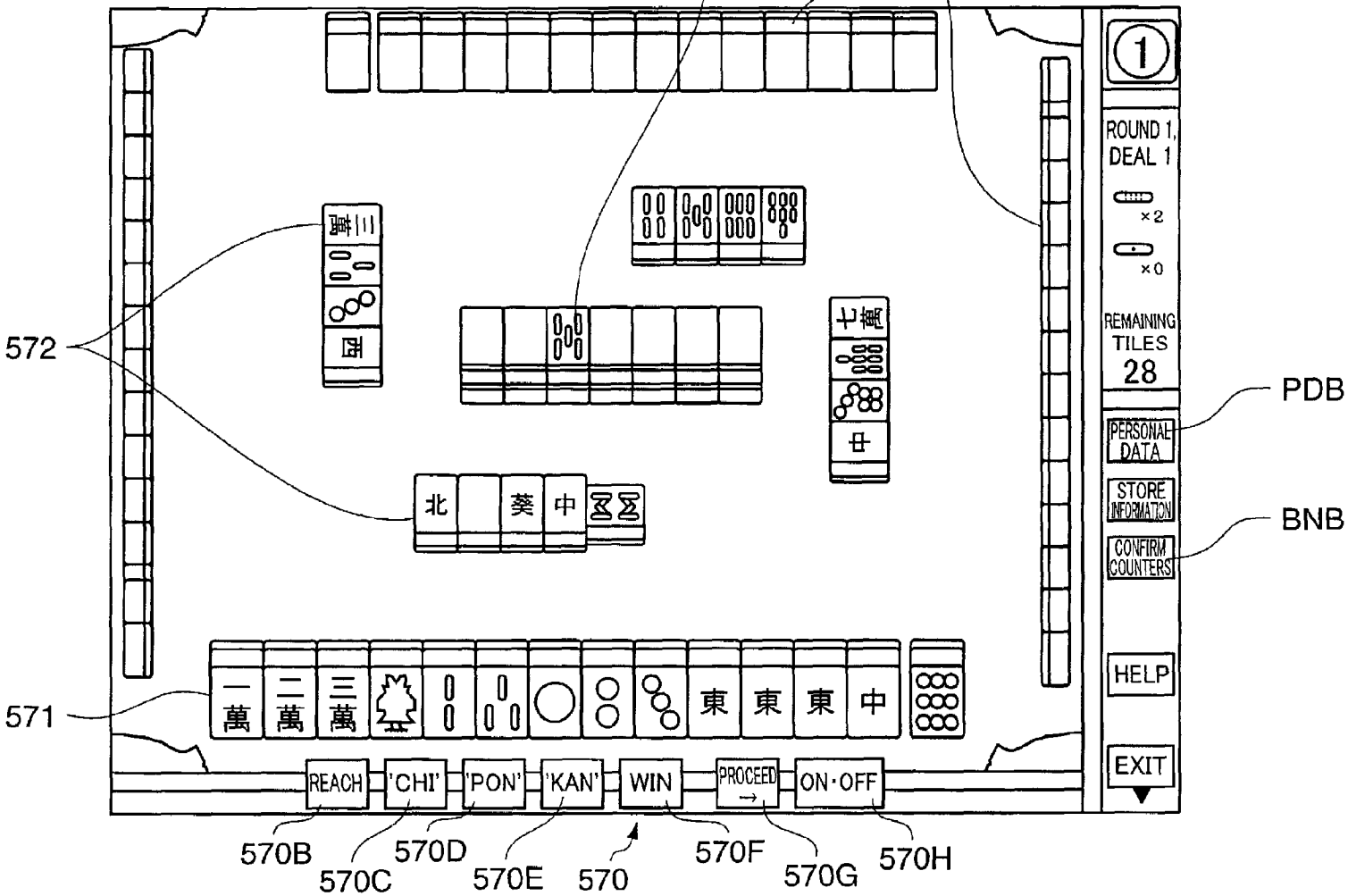
FIG. 17 is a screen drawing of a game play screen.

FIG. 17 is a screen drawing of the game play screen displayed in step S7 in the flow chart shown in FIG. 8. Displayed at the bottom of the game play screen 570 are a 'Reach' button 570B that is pressed in order to declare a reach, a 'Chi' button 570C that is pressed in order to declare a 'chi', a 'Pon' button 570D that is pressed in order to declare a 'pon', a 'Kan' button 570E that is pressed in order to declare a 'kan', a 'Win' button 570F that is used to declare that one has won the hand, a 'Proceed' button 570G that is pressed in order to continue the deal, and a declare change button 570F that is pressed in order to select whether or not the player is to make a declaration in response to the discarded tiles of other players. Displayed at the right of the screen is a counter confirmation button BNB that is pressed in order to check the number of counters possessed by the player.

Where all players at the table have selected 'Don't declare in response to other player's discard' using the declare change button 570H, when a player discards a tile, a tile can be immediately drawn by the next player. Where the player has selected 'Declare in response to other player's discard', when another player discards a tile regarding which the player could make a declaration, that discarded tile flashes to indicate that the player can make a declaration regarding that tile, and the next player cannot draw a tile until the current player either (1) makes a declaration using the 'Chi' button 570C, the 'Pon' button 570D or the 'Kan' button 570E or (2) continues the deal by pressing the 'Proceed' button 570G, or a prescribed period of time (such as five seconds) elapses.

In addition, the player's hand tiles 571 are displayed at the bottom of the game play screen 570 such that the types of tiles are visible, while the opponents' hand tiles 573 are displayed at the top and the sides of the screen such that the types of tiles are not visible. A dead wall 574 that includes a 'dora' display tile is also displayed in the game play screen 570, and discard tiles 572 are displayed around the dead wall 574.

Figure 18:
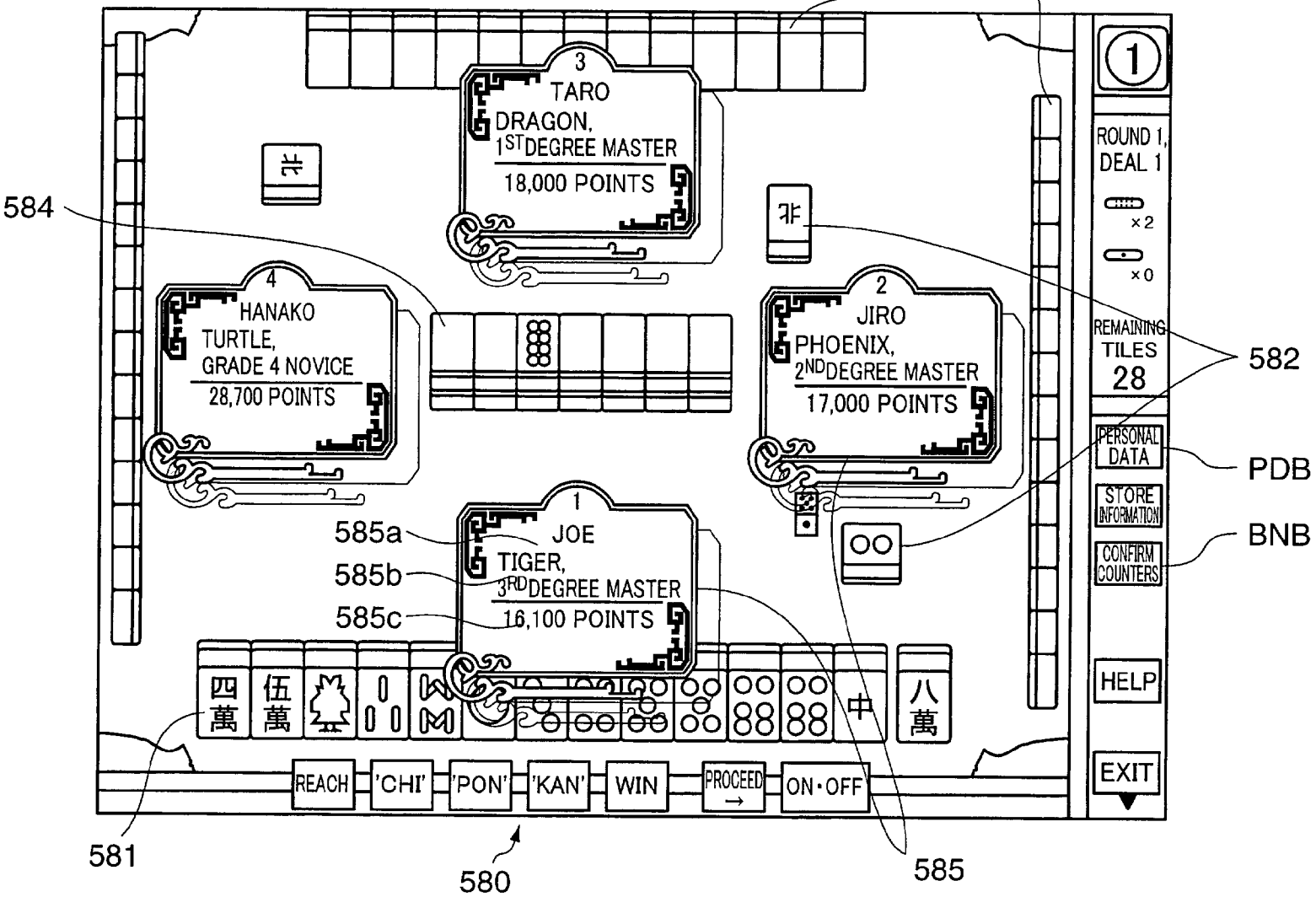
FIG. 18 is a screen drawing of a counter confirmation screen.
Figure 19:
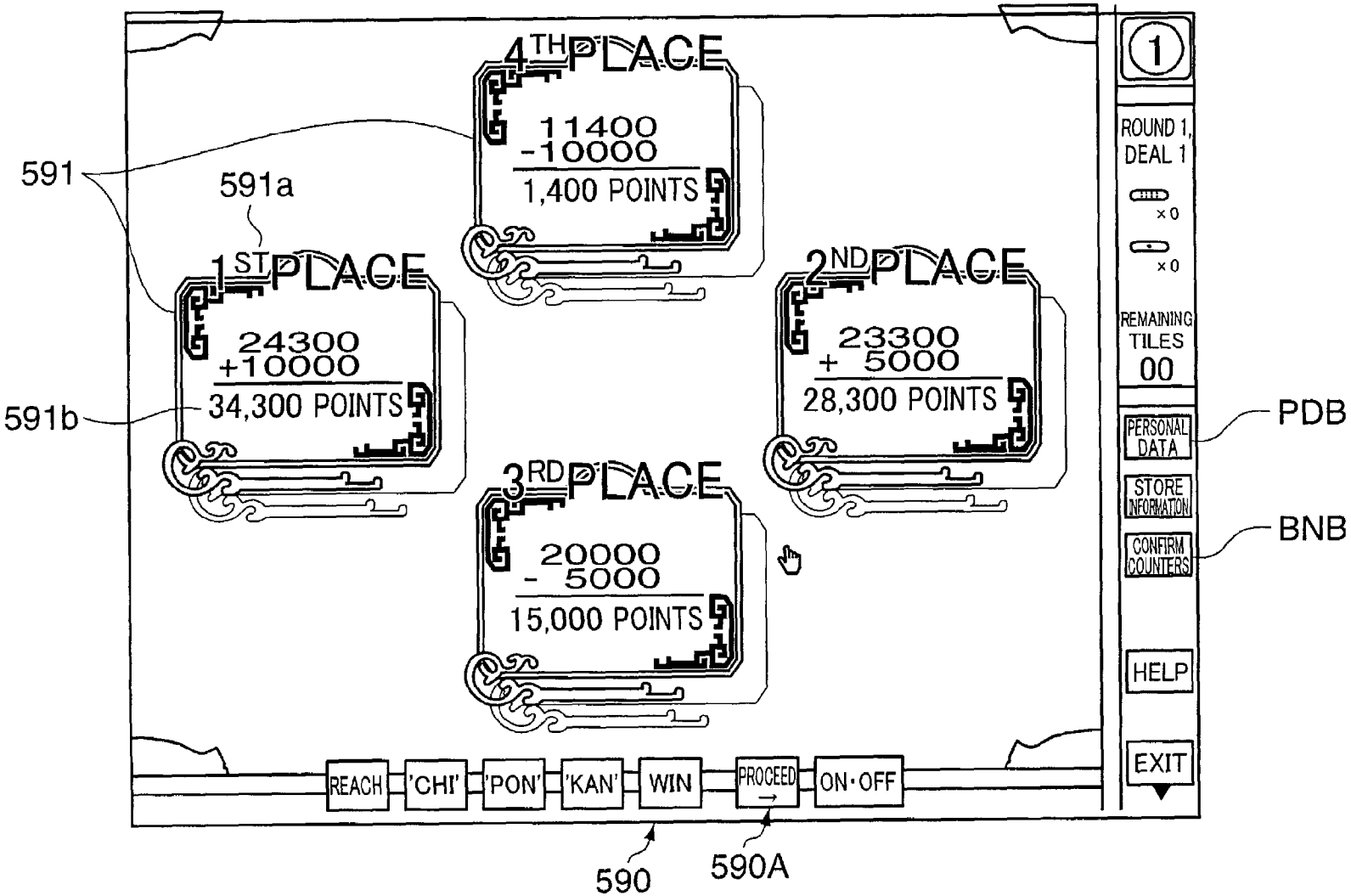
FIG. 19 is a screen drawing of a finish order display screen.

FIG. 18 is a screen drawing showing the counter confirmation screen that is displayed when the counter confirmation button BNB in the game play screen 570 is pressed. Displayed in the counter confirmation screen 580 are all the components of the game play screen 570 as well as point display areas 585 that include, for each of the four players, the player's nickname 585*a*, title and rank 585*b*, and number of points possessed 585*c*. The counter confirmation screen 580 (i.e., the point display areas 585) is displayed when the counter confirmation button BNB is pressed. It disappears after a prescribed period of time (for example, five seconds) has elapsed, and reverts to the game play screen 570.

FIG. 19 is a screen drawing of the finish order display screen displayed in step ST9 in the flow chart shown in FIG. 8. Displayed in the finish order display screen 590 are finish place 591*a* and final point totals 591*b* for all four players.

Figure 20:
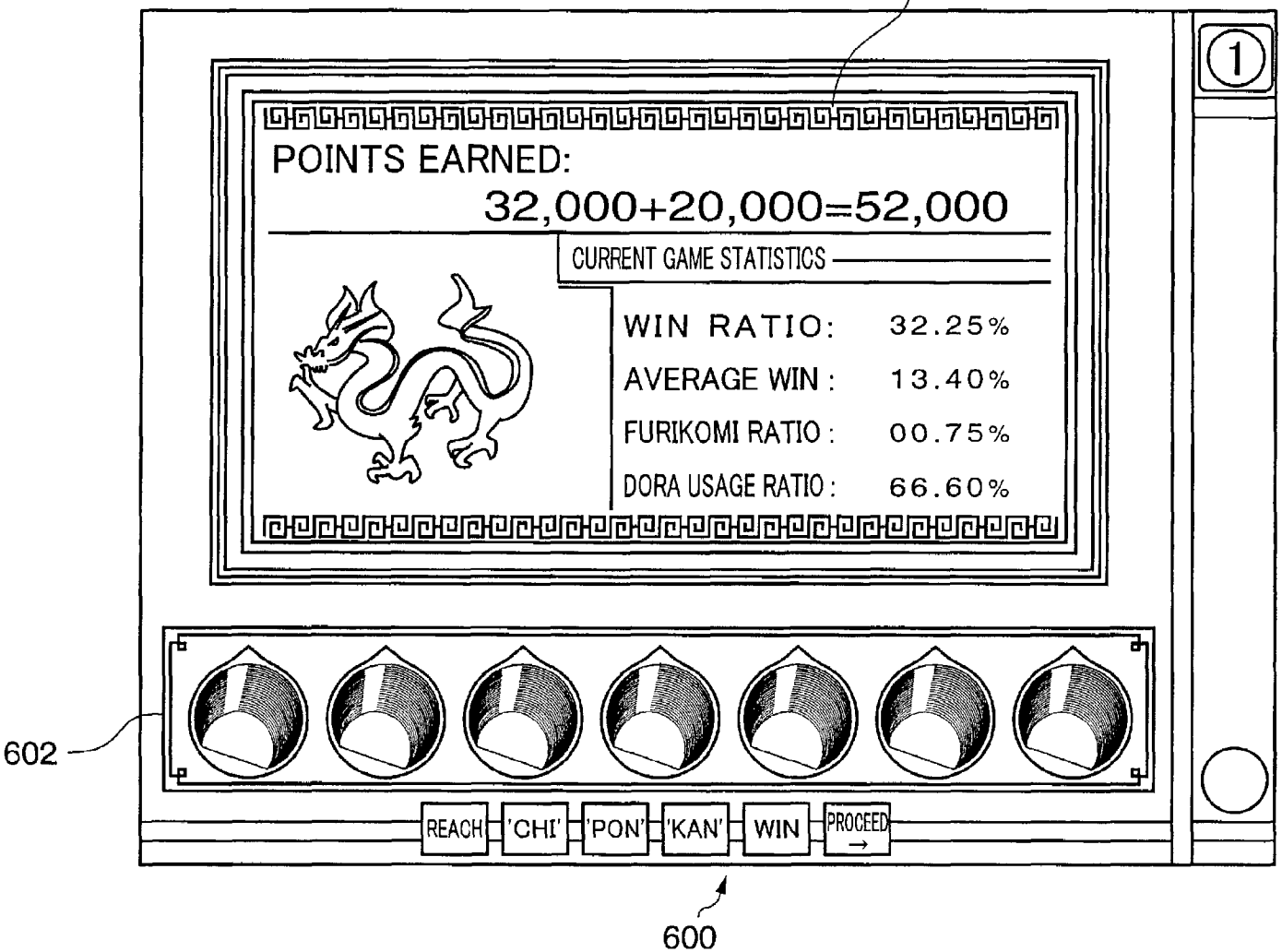
FIG. 20 is a screen drawing of an item display screen.

FIG. 20 is a screen drawing of the item display screen displayed in steps ST13 and ST17 in the flow chart shown in FIG. 8. Displayed in the item display screen 600 are a performance display area 601 that indicates the player's performance in the present game, and a required number of chips image 602 that indicates the number of chips required for the player to be promoted to the rank immediately above his current rank.

Figure 21:
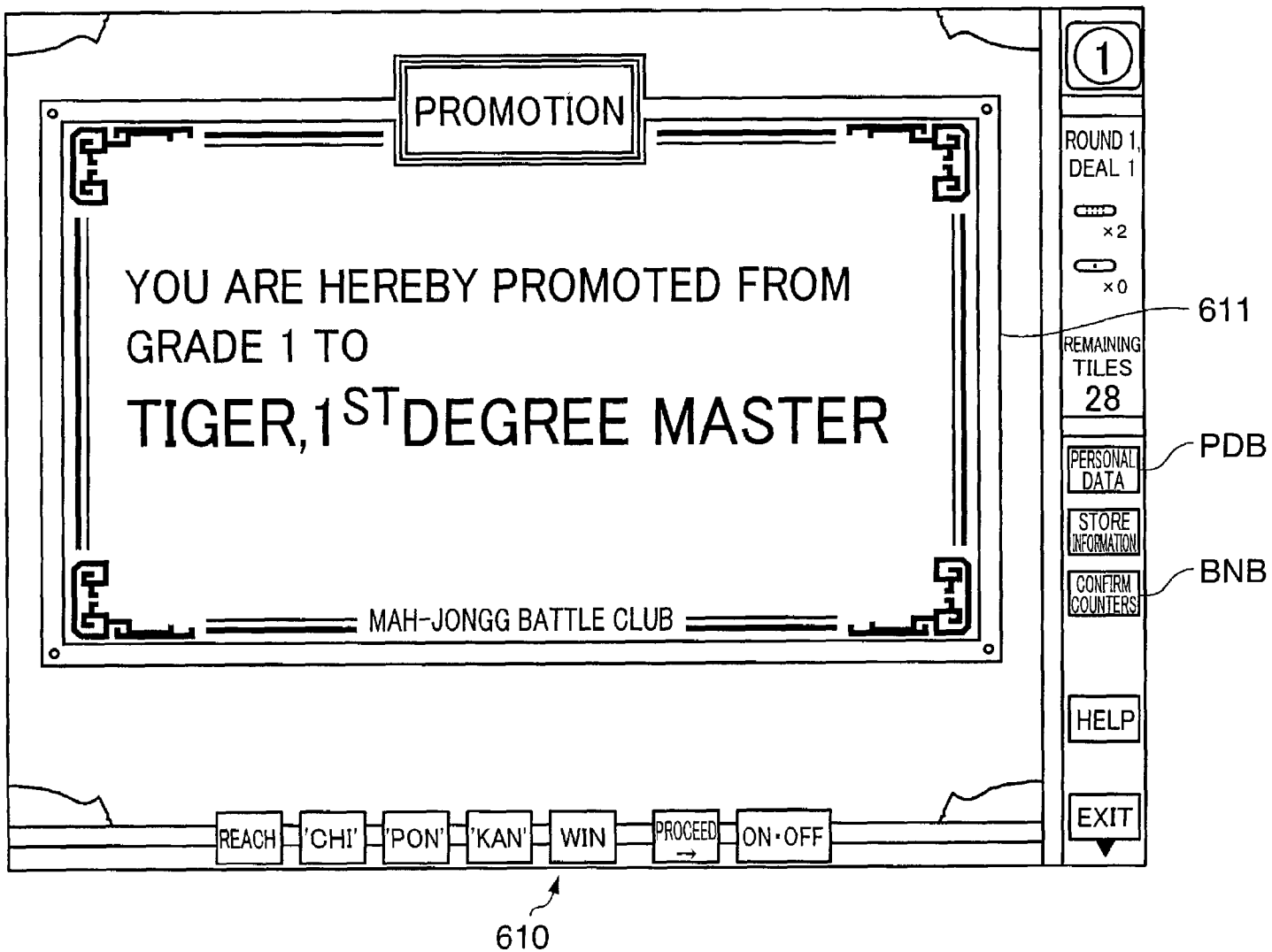
FIG. 21 is a screen drawing of a rank promotion screen.

FIG. 21 is a screen drawing of the promotion screen displayed in step ST17 in the flow chart shown in FIG. 8. Displayed in the promotion screen 610 is a promotion information area 611 that indicates the current rank and the rank following promotion.

Furthermore, the present invention can have the following variations.

(A) In the description of this embodiment, the game was a mah-jongg game, but the game may be a different game played by a plurality of players. For example, it may be a card game, a go game, a Japanese chess game or the like.

(B) In the description of this embodiment, the item assigning unit, number of deals selection unit, performance determination unit, item transfer unit, rank determination unit, parameter calculation unit, title assigning unit and opponent display unit were all contained in the CPU 161, but one or more of the item assigning unit, number of deals selection unit, performance determination unit, item transfer unit, rank determination unit, parameter calculation unit, title assigning unit and opponent display unit may be located on a server connected over the network. Where all of the item assigning unit, number of deals selection unit, performance determination unit, item transfer unit, rank determination unit, parameter calculation unit, title assigning unit and opponent display unit are located on a server, an online game can be easily played among video game apparatuses that can be connected to each other via the server.

(C) In the description of this embodiment, the rank storage unit, history storage unit and title storage unit were all contained in the RAM 162, but one or more of the rank storage unit, history storage unit and title storage unit can be located on a server that is connected over the network. Where all of the rank storage unit, history storage unit and title storage unit are located on a server, information can be managed in a unified fashion.

(D) In the description of this embodiment, the items were counted in terms of individual units, but the items can be counted in terms of amount. For example, gold may be used as the base for counting, and players may be virtually assigned items expressed in terms of grams. In this case, because the items can be assigned (or transferred) in smaller amounts, the conditions for attainment of a rank, for example, can be made more detailed, enabling the invention to be used with a wider variety of games.

(E) In the description of this embodiment, the title was assigned when a player reached $1^{st}$ degree master rank, but a title can be assigned (or an already-assigned title can be changed) each time a player rises or falls in rank. In this case, because a title indicating the characteristics of the player's approach is assigned on an updatable basis, the characteristics of the player's approach can be determined from his title even where such characteristics have changed over time.

In summary, the present invention relates to a recording medium which stores a game progress control program that controls the progress of a game played by a plurality of players while reflecting the game progress on game screens, wherein a video game apparatus is made to function by such program as history storage means that stores past game history data for each player, parameter calculation means that calculates parameters that indicate the characteristics of each player's games based on the game history data, title assigning means that assigns titles applicable during games to the players based on the calculated parameters, and title storage means that associates these titles with the respective players and stores them in memory.

According to the above invention, past game history data is stored for each player in history storage means and parameters indicating the game characteristics of each player are calculated by parameter calculation means. Furthermore, titles applicable during games are assigned to the players based on the calculated parameters, and these titles are associated with the players and stored in title storage means.

Therefore, because a title indicating the characteristics of each player's games is assigned, the player can determine the characteristics of his own games from his own title, and can determine the characteristics of the games of his opponents from their titles. Accordingly, each player can enjoy changing his game approach based on the titles of his opponents, which increases the enjoyment of the game.

In the aforementioned invention, the video game apparatus can be further made to function by such program as item assigning means that virtually assigns a prescribed number of items to players who satisfy prescribed conditions, performance determination means that determines at the end of each game the winner and losers or the order of each player's finish, item transfer means that, based on the results of the determination conducted by the performance determination means, transfers among players a prescribed number of items from among the items virtually possessed by the players, rank determination means that determines a rank that indicates the level of a player's skill at mah-jongg based on the number of items virtually possessed by the player, and rank storage means that associates the number of items and the rank with each player and stores them in memory.

According to the invention with the aforementioned feature, the item assigning means virtually assigns a prescribed number of items to players who satisfy prescribed conditions and the performance determination means determines the winner and losers or order of finish in the game each time a game is completed. Upon receiving these results, the item transfer means transfers among the players, based on the results of the determination conducted by the performance determination means, a prescribed number of items from among the items virtually possessed by the players. The rank determination means then determines, based on the number of items virtually possessed by a given player, a rank that indicates the level of the player's skill at mah-jongg. In addition, the number of items and the rank are associated with the player and stored in memory.

Therefore, because a rank indicating the level of the player's skill at mah-jongg is determined based on the number of items virtually possessed by the player, the player can reliably determine the number of items that must be won in the current game in order to increase the player's rank. In other words, the goal of the game can be clearly understood. As a result, the player's interest in playing individual games can be kindled, and the game can be made more interesting.

Moreover, in the aforementioned invention, the game can be a mah-jongg game, the game history data includes at least data regarding each player's cumulative number of deals won and cumulative number of deals played, and the parameter calculation means calculates the number of wins per deal by dividing the cumulative number of deals won by the cumulative number of deals played.

According to the invention with the above mentioned features, the game is a mah-jongg game, at least data regarding each player's cumulative number of deals won and cumulative number of deals played is included in the game history data, and the parameter calculation means calculates the number of wins per deal by dividing the cumulative number of deals won by the cumulative number of deals played. Where the number of wins per deal is large, this means the player has a 'quick win' game style, and the characteristics of the player's game style are easily revealed by the number of wins per deal.

In addition, in the aforementioned game progress control program, the game can be a mah-jongg game, the game history data includes at least data regarding each player's cumulative number of 'furikomi' (losses on one's own discard) and cumulative number of deals played, and the parameter calculation means calculates the number of 'furikomi' per deal by dividing the cumulative number of 'furikomi' by the cumulative number of deals played.

According to the invention with the aforementioned features, the game is a mah-jongg game, at least data regarding each player's cumulative number of 'furikomi' and cumulative number of deals played is included in the game history data, and the parameter calculation means calculates the number of 'furikomi' per deal by dividing the cumulative number of 'furikomi' by the cumulative number of deals played. Where the number of 'furikomi' per deal is small, this means the player has a defensive approach, and the characteristics of the player's game style are further revealed by the number of 'furikomi' per deal.

Moreover, in the aforementioned game progress control program, the game can be a mah-jongg game, the game history data includes at least data regarding the cumulative number of exponentials (fan) in each win, i.e., the cumulative number of exponentials in each player's winning hands, as well as the cumulative number of deals won by each player, and the parameter calculation means calculates the number of exponentials per win by dividing the cumulative number of exponentials by the cumulative number of deals won.

According to the invention with the aforementioned features, the game is a mah-jongg game, at least data on the cumulative number of exponentials in each win, i.e., the cumulative number of exponentials in each player's winning hands, and the cumulative number of deals won by each player, are included in the game history data, and the parameter calculation means calculates the number of exponentials per win by dividing the cumulative number of exponentials by the cumulative number of deals won. Where the number of exponentials per win is large, this means the player tends to create high-scoring hands, and the characteristics of the player's game style are further revealed by the number of exponentials per win.

Yet moreover, in the aforementioned game progress control program, the game can be a mah-jongg game, the game history data includes at least data on the cumulative number of 'dora' tiles (special bonus tiles) in each win, i.e., the cumulative number of 'dora' tiles in each player's winning hands, as well as the cumulative number of deals won by each player, and the parameter calculation means calculates the number of 'dora' tiles per win by dividing the cumulative number of 'dora' tiles by the cumulative number of deals won. It should be noted, however, the term "special tile" in claim section could also mean a special tile in ordinary sense, which has a certain mark on a face thereon and functions to increase the winning prize.

According to the invention with the aforementioned features, the game is a mah-jongg game, at least data on the cumulative number of 'dora' tiles in each win, i.e., the cumulative number of 'dora' tiles in each player's winning hands, as well as the cumulative number of deals won by each player, are included in the game history data, and the parameter calculation means calculates the number of 'dora' tiles per win by dividing the cumulative number of 'dora' tiles by the cumulative number of deals won. Where the number of 'dora' tiles (special bonus tiles) per win is large, this means that player's style involves (or depends on) the element of luck, and the characteristics of the player's game style are further revealed by the number of 'dora' tiles per win.

Furthermore, in the game progress control program, the video game apparatus can be further made to function by such program as opponent display means that displays on the game screen the rank and/or title of each opposing player.

According to the invention with the aforementioned features, because the rank and/or the title of each opponent is displayed on the game screen by the opponent display means either when the game starts or during the game, for example, the characteristics of each opponent's games can be reliably understood by checking the opponent's title on a game screen.

In the invention with the aforementioned features, the game is a mah-jongg game, the video game apparatus is further made to function by such program as number of deals selection means that, when a game is begun, displays on a game screen multiple options for the number of deals and receives selection input from the player, and the item transfer means determines the number of items to be transferred among the players based on the selected number of deals.

According to the above invention, the game is a mah-jongg game, the number of deals selection means displays on a game screen when a game is begun multiple options for the number of deals and receives selection input from the player. Furthermore, the item transfer means determines the number of items to be transferred among the players based on the selected number of deals. Therefore, as the number of deals played increases, the players' relative levels of skill become more accurately reflected in the game results, and where the number of items transferred among the players is increased, the realism of the game is increased.

The present invention takes a form of game progress control method that controls the progress of a game played by a plurality of players while reflecting the game progress on game screens, wherein past game history data for each player is stored in storage means in a video game apparatus, a parameter calculation process in which parameters that indicate characteristics regarding each player's games are calculated based on the game history data and a title assigning process in which a titles applicable during games is assigned to each player based on the calculated parameters are executed in the video game apparatus, and these titles are associated with the players and stored in storage means in the video game apparatus.

According to the invention in the aforementioned form, each player's past game history data is stored in storage means, and parameters indicating the characteristics of each player's games are calculated in the parameter calculation process based on this game history data. Furthermore, in the title assigning process, titles applicable during games are assigned to the players based on the calculated parameters, and these titles are associated with the players and stored in storage means.

Therefore, because titles indicating the characteristics of each player's games are assigned, a player can not only learn the characteristics of his own games from his own title, but can also learn the characteristics of his opponents' games from their titles. As a result, each player can enjoy changing his game style based on the titles of his opponents, thereby making the game more interesting.

The present invention also takes a form of a video game apparatus that controls the progress of a game played by a plurality of players while reflecting the game progress on game screens, wherein such apparatus includes history storage means that stores past game history data for each player, parameter calculation means that calculates parameters that indicate characteristics regarding each player's games based on the game history data, title assigning means that assigns titles applicable during games to the players based on the calculated parameters, and title storage means that associates these titles with the players and stores them in memory.

According to the invention in the aforementioned form, past game history data for each player is stored in history storage means, and parameters that indicate characteristics regarding each player's games are calculated by parameter calculation means based on the game history data. Furthermore, titles applicable during games are assigned to the players based on the calculated parameters, and these titles are associated with the players and stored in memory by title storage means.

Therefore, because titles indicating the characteristics of each player's games are assigned, a player can not only learn the characteristics of his own games from his own title, but can also learn the characteristics of his opponents' games from their titles. As a result, each player can enjoy changing his game strategy based on the titles of his opponents, thereby making the game more interesting.

This application is based on Japanese patent application serial no. 2001-319866, filed in Japan Patent Office on Oct. 17, 2001, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A recording medium which stores an executable game progress control program that controls progress of a game played by a plurality of players while reflecting the game progress on game screens, said game progress control program being configured to enable a video game apparatus to function as:

history storage means for storing past game history data for each player, parameter calculation means for calculating, based on the game history stored, parameter values for game playing parameters that indicate a plurality of game playing characteristic actions of each player in playing the game wherein ranges of the parameter values for respective ones of the game playing parameters are game playing parameter dependent and differ from one another, level determination means for converting the parameter values to level values based on conversion criteria specific to respective ones of the game playing parameters and which differ from each other, title assigning means for assigning titles applicable during games to the players based on relative levels of the level values converted from the parameter values of each player, said titles being indicative of the game playing characteristic actions of each player in playing the game, title storage means for associating the titles assigned with the respective players and storing the associated titles, and display means for displaying, on the game screens, the titles associated with respective opposing ones of the plurality of players.

2. The recording medium according to claim 1, wherein said program enables said video game apparatus to further function as:

item assigning means that virtually assigns a prescribed number of items to players who satisfy prescribed conditions, performance determination means that determines at an end of each game a winner and losers or an order of each player's finish, item transfer means that, based on the results of the determination conducted by the performance determination means, transfers among players a prescribed number of items from among the items virtually possessed by the players, rank determination means that determines a rank that indicates the level of a player's skill at games based on the number of items virtually possessed by the player, and rank storage means that associates the number of items and the rank with each player and stores them in memory.

3. The recording medium according to claim 2, wherein said program enables said video game apparatus to further function as an opponent display means that displays on a game screen the ranks of the opposing players.

4. The recording medium according to claim 2, wherein:

said game is a mah-jongg game, said program enables said video game apparatus to further function as a number of deals selection means that, when a game is begun, displays on a game screen multiple options for the number of deals and receives a selection input from the player, and said item transfer means determines a number of items to be transferred among the players based on the selected number of deals.

5. The recording medium according to claim 1, wherein said game is a mah-jongg game, said game history data includes at least data regarding each player's cumulative number of deals won and cumulative number of deals played, and said parameter calculation means calculates a number of wins per deal by dividing the cumulative number of deals won by the cumulative number of deals played.

6. The recording medium according to claim 1, wherein said game is a mah-jongg game, said game history data includes at least data regarding each player's cumulative number of losses on his/her own discard and cumulative number of deals played, and said parameter calculation means calculates a number of losses on his/her own discard per deal by dividing the cumulative number of losses on his/her own discard by the cumulative number of deals played.

7. The recording medium according to claim 1, wherein said game is a mah-jongg game, said game history data includes at least data regarding a cumulative number of exponentials in each win and said parameter calculation means calculates a number of exponentials per win by dividing the cumulative number of exponentials by a cumulative number of deals won.

8. The recording medium according to claim 1, wherein said game is a mah-jongg game, said game history data includes at least data on a cumulative number of special tiles in each win and a cumulative number of deals won by each player, and said parameter calculation means calculates a number of the special tiles per win by dividing the cumulative number of the special tiles by the cumulative number of deals won.

9. A recording medium according to claim 1, wherein said display means displays said titles assigned to said plurality of players on the screen of the video game apparatus before the start of the game.

10. The recording medium according to claim 1, wherein each of said titles indicates a name of a character that conveys an image associated with the corresponding one of the game playing characteristic actions.

11. The recording medium according to claim 10, wherein each of said titles indicates a name of a character selected from a group consisting of a phoenix, a turtle, a dragon, and a tiger.

12. A game progress control method that controls progress of a game with a video game apparatus played by a plurality of players while reflecting the game progress on game screens, said method comprising the steps of:

storing past game history data for each player in storage means in the video game apparatus, calculating, based on the game history stored, parameter values for game playing parameters that indicate a plurality of game playing characteristic actions of each player in playing the game wherein ranges of the parameter values for respective ones of the game playing parameters are game playing parameter dependent and differ from one another, converting the parameter values to level values based on conversion criteria specific to respective ones of the game playing parameters and which differ from each other, assigning titles applicable during games to the players based on relative levels of the level values converted from the parameter values of each player, said titles being indicative of the game playing characteristic actions of each player in playing the game, associating the assigned titles with the players and storing the assigned titles in an associated state in storage means in the video game apparatus, and displaying, on the game screens, the titles assigned associated with respective opposing ones of the plurality of players.

13. A video game apparatus that controls progress of a game played by a plurality of players while reflecting the game progress on game screens, said apparatus comprising:

history storage means for storing past game history data for each player, parameter calculation means for calculating, based on the game history stored, parameter values for game playing parameters that indicate a plurality of game playing characteristic actions of each player in playing the game wherein ranges of the parameter values for respective ones of the game playing parameters are game playing parameter dependent and differ from one another, level determination means for converting the parameter values to level values based on conversion criteria specific to respective ones of the game playing parameters and which differ from each other, title assigning means for assigning titles applicable during games to the players based on relative levels of the level values converted from the parameter values of each player, said titles being indicative of the game playing characteristic actions of each player in playing the game, title storage means for associating said titles assigned with the respective players and for storing the associated titles, and display means for displaying on the game screens the titles assigned associated with respective opposing ones of the plurality of players.

14. A recording medium which stores an executable game progress control program that controls progress of a game played by a plurality of players while reflecting the game progress on game screens, said game progress control program being configured to enable a video game apparatus to function as:

history storage means for storing past game history data for each player playing the game and the game being mah-jongg, parameter calculation means for calculating parameters that indicate a plurality of game playing characteristic actions of each player in playing the game based on the game history data, title assigning means for assigning titles applicable during games to the players based on relative levels of the calculated parameters of each player, said titles indicating relative levels of the game playing characteristic actions of each player in playing the game, title storage means for associating the titles assigned with the respective players and storing the associated titles, and display means for displaying, on the game screens, the titles associated with respective opposing ones of the plurality of players, said game history data includes at least data regarding each player's cumulative number of deals won and cumulative number of deals played, and said parameter calculation means calculates as one of said parameters a number of wins per deal by dividing the cumulative number of deals won by the cumulative number of deals played.

15. The recording medium according to claim 14, wherein each of said titles indicates a name of a character selected from a group consisting of a phoenix, a turtle, a dragon, and a tiger.

16. The recording medium according to claim 14, wherein said game history data includes at least data regarding each player's cumulative number of losses on his/her own discard and cumulative number of deals played, and said parameter calculation means calculates as one of said parameters a number of losses on his/her own discard per deal by dividing the cumulative number of losses on his/her own discard by the cumulative number of deals played.

17. The recording medium according to claim 14, wherein said game history data includes at least data regarding a cumulative number of exponentials in each win and said parameter calculation means calculates as one of said parameters a number of exponentials per win by dividing the cumulative number of exponentials by a cumulative number of deals won.

18. The recording medium according to claim 14, wherein said game history data includes at least data on a cumulative number of special tiles in each win and a cumulative number of deals won by each player, and said parameter calculation means calculates as one of said parameters a number of the special tiles per win by dividing the cumulative number of the special tiles by the cumulative number of deals won.

19. The recording medium according to claim 14, wherein said program enables said video game apparatus to further function as:

item assigning means that virtually assigns a prescribed number of items to players who satisfy prescribed conditions, performance determination means that determines at an end of each game a winner and losers or an order of each player's finish, item transfer means that, based on the results of the determination conducted by the performance determination means, transfers among players a prescribed number of items from among the items virtually possessed by the players, rank determination means that determines a rank that indicates the level of a player's skill at games based on the number of items virtually possessed by the player, rank storage means that associates the number of items and the rank with each player and stores them in memory, a number of deals selection means that, when a game is begun, displays on a game screen multiple options for the number of deals and receives a selection input from the player, and said item transfer means determining a number of items to be transferred among the players based on the selected number of deals.

20. The recording medium according to claim 19, wherein each of said titles includes a name of a character selected from a group consisting of a phoenix, a turtle, a dragon, and a tiger, said phoenix represents a quick win type player, said turtle represents a defense-first type player, said dragon represents a luck-dependent type player and said tiger represents an attack-minded player.

* * * * *